US011429032B2

(12) United States Patent
Shibata et al.

(10) Patent No.: US 11,429,032 B2
(45) Date of Patent: Aug. 30, 2022

(54) TONER AND METHOD OF PRODUCING TONER

(71) Applicant: CANON KABUSHIKI KAISHA, Tokyo (JP)

(72) Inventors: Takaho Shibata, Tokyo (JP); Yuichi Mizo, Toride (JP); Koh Ishigami, Abiko (JP); Takakuni Kobori, Toride (JP); Masaharu Miura, Toride (JP); Takeshi Ohtsu, Toride (JP); Yosuke Iwasaki, Tokyo (JP); Daisuke Yamashita, Matsudo (JP); Ryo Nakajima, Nagareyama (JP); Wakiko Katsumata, Kashiwa (JP); Hitoshi Sano, Matsudo (JP); Kenta Mitsuiki, Toride (JP); Rei Hijikawa, Kashiwa (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 17/002,879

(22) Filed: Aug. 26, 2020

(65) Prior Publication Data

US 2021/0063903 A1 Mar. 4, 2021

(30) Foreign Application Priority Data

Aug. 29, 2019 (JP) ..... JP2019-156273

(51) Int. Cl.
*G03G 9/087* (2006.01)
*G03G 9/08* (2006.01)

(52) U.S. Cl.
CPC ..... *G03G 9/08755* (2013.01); *G03G 9/081* (2013.01); *G03G 9/0815* (2013.01); *G03G 9/0819* (2013.01); *G03G 9/08728* (2013.01)

(58) Field of Classification Search
CPC ..... G03G 9/0819; G03G 9/08728; G03G 9/08755; G03G 9/08791; G03G 9/0975; G03G 9/09791
See application file for complete search history.

(56) References Cited

U.S. PATENT DOCUMENTS 5,424,810 A 6/1995 Tomiyama et al.
5,464,722 A 11/1995 Tomiyama et al.
(Continued)

FOREIGN PATENT DOCUMENTS

JP 2002-351148 12/2002
JP 2006-145800 6/2006
JP 2013-088686 5/2013

OTHER PUBLICATIONS

U.S. Appl. No. 16/987,599, Junichi Tamura, filed Aug. 7, 2020.
U.S. Appl. No. 17/092,602, Kentaro Kamae, filed Nov. 9, 2020.

*Primary Examiner* — Peter L Vajda
*Assistant Examiner* — Boone Alexander Evans
(74) *Attorney, Agent, or Firm* — Venable LLP

(57) ABSTRACT

A toner containing a toner particle that contains a binder resin including a polyester resin, and a polyolefin resin having —COOM that is a neutralized carboxy group with a monovalent metal ion M, wherein the polyolefin resin having —COOM is a polymer in which a vinyl polymer is bonded to a polyolefin, a content of a monomer unit containing —COOM in the polyolefin resin having —COOM is 1 to 20 mass %, and in a FT-IR spectrum obtained through measurement of a large particle size-side particle group and a small particle size-side particle group obtained by dividing the toner into two substantially equal parts, on a number basis, a ratio of the intensity of a maximum absorption peak in a range from 1545 $cm^{-1}$ to 1555 $cm^{-1}$ with respect to the intensity of a maximum absorption peak in a range from 1713 $cm^{-1}$ to 1723 $cm^{-1}$ exhibits a specific relationship.

9 Claims, 1 Drawing Sheet

(56) References Cited

U.S. PATENT DOCUMENTS 5,700,616 A 12/1997 Kasuya et al.
5,712,073 A 1/1998 Katada et al.
5,736,288 A 4/1998 Kasuya et al.
5,972,553 A 10/1999 Katada et al.
6,002,895 A 12/1999 Kasuya et al.
6,007,957 A 12/1999 Kobori et al.
6,156,471 A 12/2000 Kobori et al.
6,203,959 B1 3/2001 Tanikawa et al.
6,235,441 B1 5/2001 Tanikawa et al.
6,482,881 B1 * 11/2002 Shibata ..... C01B 25/32 423/430
6,653,036 B1 11/2003 Tanikawa et al.
6,670,087 B2 12/2003 Fujikawa et al.
7,147,981 B2 12/2006 Fujikawa et al.
7,279,262 B2 10/2007 Fujikawa et al.
7,288,348 B2 10/2007 Hayami et al.
7,396,626 B2 7/2008 Fujikawa et al.
7,396,629 B2 7/2008 Baba et al.
7,611,813 B2 11/2009 Ida et al.
7,629,100 B2 12/2009 Okamoto et al.
7,767,370 B2 8/2010 Ishigami et al.
7,833,687 B2 11/2010 Kato et al.
7,855,042 B2 12/2010 Kobori et al.
7,858,283 B2 12/2010 Ishigami et al.
7,906,262 B2 3/2011 Ishigami et al.
7,927,775 B2 4/2011 Komatsu et al.
7,939,233 B2 5/2011 Inoue et al.
8,114,562 B2 2/2012 Ishigami et al.
8,137,886 B2 3/2012 Baba et al.
8,288,069 B2 10/2012 Fujikawa et al.
8,298,742 B2 10/2012 Okamoto et al.
8,323,726 B2 12/2012 Naka et al.
8,697,327 B2 4/2014 Shibata et al.
8,921,023 B2 12/2014 Baba et al.
8,927,188 B2 1/2015 Naka et al.
8,945,805 B2 2/2015 Baba et al.
8,974,994 B2 3/2015 Kamae et al.
8,986,914 B2 3/2015 Fujikawa et al.
9,034,551 B2 5/2015 Endo et al.
9,057,970 B2 6/2015 Ida et al.
9,058,924 B2 6/2015 Komatsu et al.
9,063,443 B2 6/2015 Ishigami et al.
9,075,328 B2 7/2015 Minagawa et al.
9,152,088 B1 10/2015 Kobori et al.
9,348,247 B2 5/2016 Ida et al.
9,348,253 B2 5/2016 Kanno et al.
9,372,420 B2 6/2016 Mizo et al.
9,417,540 B2 8/2016 Hashimoto et al.
9,436,112 B2 9/2016 Iwasaki et al.
9,540,483 B2 1/2017 Ida et al.
9,651,883 B2 5/2017 Hama et al.
9,665,021 B2 5/2017 Ohtsu et al.
9,665,023 B2 5/2017 Kamae et al.
9,665,026 B2 5/2017 Iwasaki et al.
9,671,707 B2 6/2017 Minagawa et al.
9,696,644 B2 7/2017 Ida et al.
9,897,934 B2 2/2018 Tamura et al.
9,915,885 B2 3/2018 Katsumata et al.
9,969,834 B2 * 5/2018 Ohtsu ..... G03G 9/081
10,012,918 B2 7/2018 Ishigami et al.
10,012,920 B2 7/2018 Shibata et al.
10,012,921 B2 7/2018 Kamae et al.
10,036,970 B2 7/2018 Kanno et al.
10,078,281 B2 9/2018 Ida et al.
10,082,743 B2 9/2018 Hama et al.
10,088,765 B2 10/2018 Miyakai et al.
10,133,201 B2 11/2018 Kamae et al.
10,146,146 B2 12/2018 Komatsu et al.
10,175,595 B2 1/2019 Onozaki et al.
10,197,936 B2 2/2019 Onozaki et al.
10,203,619 B2 2/2019 Yamashita et al.
10,216,108 B2 2/2019 Iwasaki et al.
10,228,629 B2 3/2019 Tamura et al.
10,234,777 B2 3/2019 Ohtsu et al.
10,401,748 B2 9/2019 Hashimoto et al.
10,423,090 B2 9/2019 Ohtsu et al.
10,451,986 B2 10/2019 Sano et al.
10,474,049 B2 11/2019 Onozaki et al.
10,642,178 B2 5/2020 Yamashita et al.
10,775,710 B1 9/2020 Kamae et al.
2009/0233212 A1 9/2009 Fujikawa et al.
2010/0028796 A1 2/2010 Nakamura et al.
2010/0183971 A1 7/2010 Fujikawa et al.
2010/0248126 A1 9/2010 Ishigami et al.
2011/0097661 A1 4/2011 Ishigami et al.
2012/0094225 A1 4/2012 Ishigami et al.
2013/0108955 A1 5/2013 Shibata et al.
2013/0244159 A1 9/2013 Ishigami et al.
2013/0288173 A1 10/2013 Hashimoto et al.
2013/0309603 A1 11/2013 Takahashi et al.
2014/0134535 A1 5/2014 Baba et al.
2014/0137428 A1 5/2014 Takenaka et al.
2014/0329176 A1 11/2014 Kanno et al.
2015/0003875 A1 1/2015 Ishigami et al.
2015/0099227 A1 4/2015 Ida et al.
2017/0283539 A1 * 10/2017 Shiga ..... C08F 255/08
2018/0275540 A1 9/2018 Matsuo et al.
2018/0314176 A1 11/2018 Ikeda et al.
2020/0057397 A1 2/2020 Murayama et al.
2020/0064751 A1 2/2020 Murayama et al.
2020/0073266 A1 3/2020 Ohtsu et al.
2020/0166862 A1 5/2020 Onozaki et al.
2020/0183295 A1 6/2020 Kanno et al.

* cited by examiner

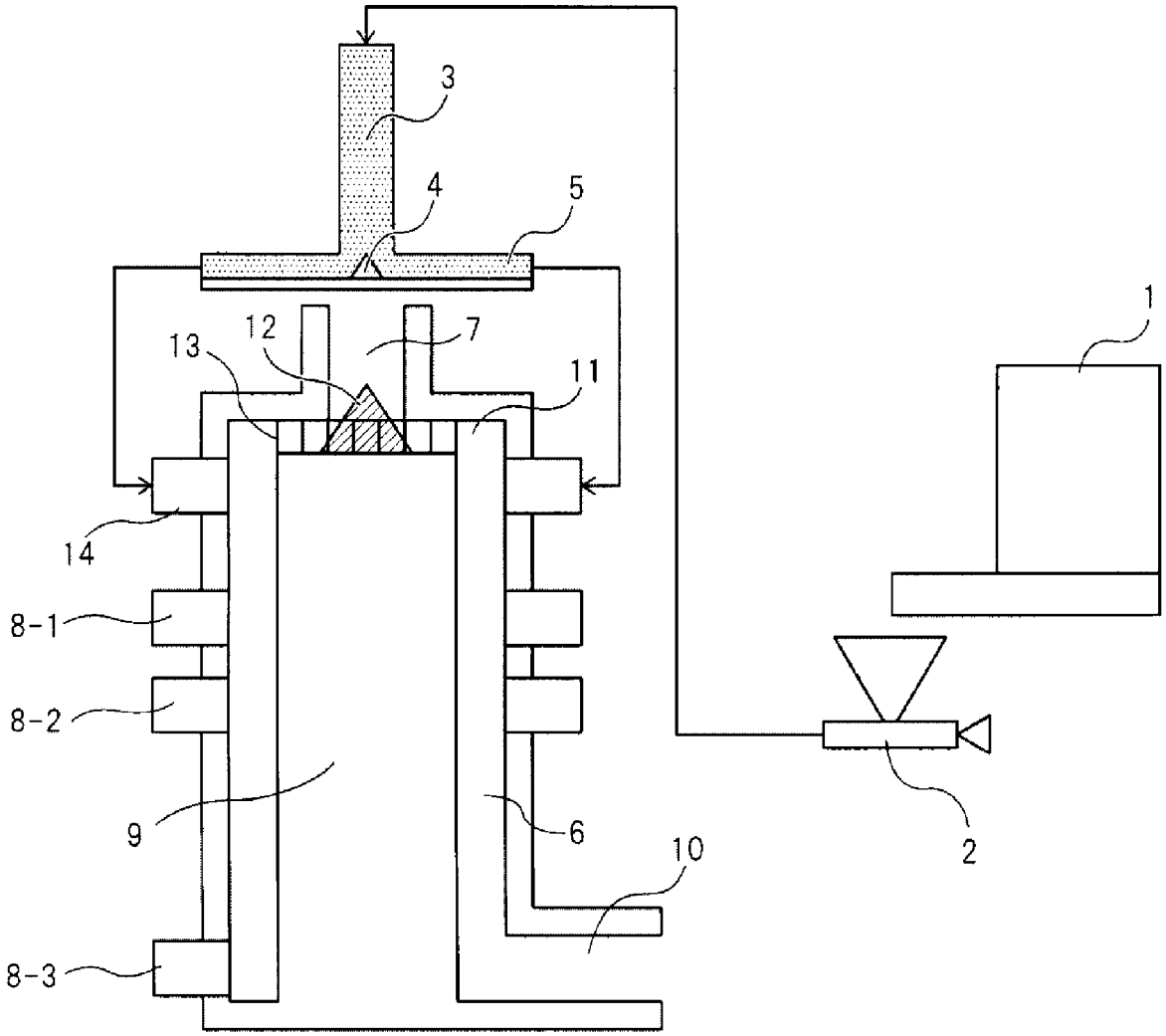
3
4
5
1
12
7
13
11
14
8-1
8-2
9
6
10
2
8-3

TONER AND METHOD OF PRODUCING TONER

BACKGROUND OF THE INVENTION

Field of the Invention

The present invention relates to a toner that is used in electrophotographic systems and electrostatic recording systems, and to a method of producing the toner.

Description of the Related Art

The growing spread of the use of electrophotographic full-color copiers in recent years has been accompanied by demands for not only higher speeds and higher image quality, but also additional performance improvements in terms of maintenance costs and the like, for instance energy-saving performance.

Toners of small particle size are demanded for the purpose of improving dot reproducibility, as a concrete measure for improving image quality.

Therefore, Japanese Patent Application Publication No. 2013-088686 proposes a toner having a small particle size and a sharp particle size distribution, in order to improve dot reproducibility.

Japanese Patent Application Publication No. 2006-145800 proposes a toner in which a coverage ratio of silica fine particles is adjusted for each particle size range thereof, in order to improve charging performance and yield in toners that exhibit variability in particle size distribution.

Further, Japanese Patent Application Publication No. 2002-351148 proposes a toner in which a resin containing sulfonic acid groups is added as a charge control agent for improving the charging performance of the toner.

SUMMARY OF THE INVENTION

The toner disclosed in Japanese Patent Application Publication No. 2013-088686 affords good image quality for image output in normal-temperature, normal-humidity environments. However, a shell layer and the inorganic fine particles have uniform coverage, regardless of the particle size, and hence the toner surface is uniform and surface charge density is constant. As a result, a charge quantity per toner particle decreases, in terms of surface area, as the toner particle size becomes smaller.

The charge quantity of toner generally changes, with respect to relative humidity, on account of the influence of for instance the amount of adsorbed moisture and resistance changes on the toner surface. Accordingly, toners of small particle size in high-temperature, high-humidity environments exhibit a low electric field strength dependence, since the charge quantity is significantly small in that case. It has been found that, as a result, toner remains adhered to an electrostatic latent image bearing member and fogging may occur, in AC developing systems, since forces derived from pullback bias from the electrostatic latent image bearing are weak.

It has been further found that image output over long periods of time results in embedding, into the toner, of inorganic fine particles that are externally added to the toner; in turn, this gives rise to further drops in responsiveness towards pullback bias, and more pronounced fogging.

In the toner disclosed in Japanese Patent Application Publication No. 2006-145800, the coverage ratio of inorganic fine particles is adjusted for each particle size range, and hence surface charge density varies depending on particle size. It has been found, however, that fogging becomes more pronounced since the coverage ratio is adjusted in a way that the charging performance of toner on the fine powder side is curtailed.

A resin containing sulfonic acid groups is incorporated into the toner described in Japanese Patent Application Publication No. 2002-351148, to thereby increase charge quantity in high-temperature, high-humidity environments. The occurrence of fogging in this toner can be suppressed, since the charging ability of the toner as a whole, including also the fine powder side, can be improved. However, the charge quantity in low-temperature, low-humidity environments increases readily, and in particular the charge quantity becomes excessively large on a coarse powder side; it was found that, as a result, in some instances electrostatic attachment forces between the toner and a developer carrier increase, the developing performance in the electrostatic latent image bearing member drops, and image density decreases.

A trade-off exists thus between image density stability and fogging suppression. There is an urgent need for developing toners having superior image density stability and in which fogging suppression can be maintained, also over long-term image output, to overcome the above trade-off. Specifically, it is an object of the present invention to provide a toner having good image density stability and in which fogging can be suppressed.

A toner comprising a toner particle that contains a binder resin including a polyester resin, and a polyolefin resin having —COOM that is a neutralized carboxy group with a monovalent metal ion M, wherein the polyolefin resin having —COOM is a polymer in which a vinyl polymer is bonded to a polyolefin;

a content ratio of a monomer unit containing —COOM in the polyolefin resin having —COOM is from 1 mass % to 20 mass %;

the toner satisfies an expression (1);

$$1.10 \leq (As/Bs)/(Al/Bl) \leq 2.00 \quad (1)$$

where when the toner is divided into two groups, i.e. a first group and a second group with an inertial classifier, the first group including a larger size of the toner particles, and the second group including smaller size of the toner particles, and the number of the toner particles in the first group being substantially equal to the number of the toner particles in the second group, As denotes a ratio of an intensity of a maximum absorption peak in a range from 1545 $cm^{-1}$ to 1555 $cm^{-1}$, assigned to —COOM contained in the polyolefin resin, with respect to an intensity of a maximum absorption peak in a range from 1713 $cm^{-1}$ to 1723 $cm^{-1}$, assigned to carbonyl in the polyester resin, in a FT-IR spectrum obtained through measurement of the second group in accordance with an ATR method, using Ge as an ATR crystal, and under a condition where an infrared light incidence angle is set to 45°;

Bs denotes a ratio of an intensity of a maximum absorption peak in a range from 1545 $cm^{-1}$ to 1555 $cm^{-1}$, assigned to —COOM contained in the polyolefin resin, with respect to an intensity of a maximum absorption peak in a range from 1713 $cm^{-1}$ to 1723 $cm^{-1}$, assigned to carbonyl in the polyester resin, in a FT-IR spectrum obtained through measurement of the second group in accordance with an ATR method, using diamond as an ATR crystal, and under a condition where an infrared light incidence angle is set to 45°;

Al denotes a ratio of an intensity of a maximum absorption peak in a range from 1545 $cm^{-1}$ to 1555 $cm^{-1}$, assigned to —COOM contained in the polyolefin resin, with respect to an intensity of a maximum absorption peak in a range from 1713 $cm^{-1}$ to 1723 $cm^{-1}$, assigned to carbonyl in the polyester resin, in a FT-IR spectrum obtained through measurement of the first group in accordance with an ATR method, using Ge as an ATR crystal, and under a condition where an infrared light incidence angle is set to 45°; and Bl denotes a ratio of an intensity of a maximum absorption peak in a range from 1545 $cm^{-1}$ to 1555 $cm^{-1}$, assigned to —COOM contained in the polyolefin resin, with respect to an intensity of a maximum absorption peak in a range from 1713 $cm^{-1}$ to 1723 $cm^{-}$, assigned to carbonyl in the polyester resin, in a FT-IR spectrum obtained through measurement of the first group in accordance with an ATR method, using diamond as an ATR crystal, and under a condition where an infrared light incidence angle is set to 45°.

The present invention provides a toner having good image density stability and in which fogging can be suppressed.

Further features of the present invention will become apparent from the following description of exemplary embodiments with reference to the attached drawings.

BRIEF DESCRIPTION OF THE DRAWINGS

The FIGURE is an example of a heat sphering treatment device.

DESCRIPTION OF THE EMBODIMENTS

Unless specifically indicated otherwise, expressions such as "from XX to YY" and "XX to YY" that show numerical value ranges refer to numerical value ranges that include the lower limit and upper limit that are the end points.

The present disclosure relates to a toner comprising a toner particle that contains a binder resin including a polyester resin, and a polyolefin resin having —COOM that is a neutralized carboxy group with a monovalent metal ion M, wherein the polyolefin resin having —COOM is a polymer in which a vinyl polymer is bonded to a polyolefin;

a content ratio of a monomer unit containing —COOM in the polyolefin resin having —COOM is from 1 mass % to 20 mass %;

the toner satisfies an expression (1);

$$1.10 \leq (As/Bs)/(Al/Bl) \leq 2.00 \quad (1)$$

where when the toner is divided into two groups, i.e. a first group and a second group with an inertial classifier, the first group including a larger size of the toner particles, and the second group including smaller size of the toner particles, and the number of the toner particles in the first group being substantially equal to the number of the toner particles in the second group, As denotes a ratio of an intensity of a maximum absorption peak in a range from 1545 $cm^{-1}$ to 1555 $cm^{-1}$, assigned to —COOM contained in the polyolefin resin, with respect to an intensity of a maximum absorption peak in a range from 1713 $cm^{-1}$ to 1723 $cm^{-1}$, assigned to carbonyl in the polyester resin, in a FT-IR spectrum obtained through measurement of the second group in accordance with an ATR method, using Ge as an ATR crystal, and under a condition where an infrared light incidence angle is set to 45°;

Bs denotes a ratio of an intensity of a maximum absorption peak in a range from 1545 $cm^{-1}$ to 1555 $cm^{-1}$, assigned to —COOM contained in the polyolefin resin, with respect to an intensity of a maximum absorption peak in a range from 1713 $cm^{-1}$ to 1723 $cm^{-1}$, assigned to carbonyl in the polyester resin, in a FT-IR spectrum obtained through measurement of the second group in accordance with an ATR method, using diamond as an ATR crystal, and under a condition where an infrared light incidence angle is set to 45°;

Al denotes a ratio of an intensity of a maximum absorption peak in a range from 1545 $cm^{-1}$ to 1555 $cm^{-1}$, assigned to —COOM contained in the polyolefin resin, with respect to an intensity of a maximum absorption peak in a range from 1713 $cm^{-1}$ to 1723 $cm^{-1}$, assigned to carbonyl in the polyester resin, in a FT-IR spectrum obtained through measurement of the first group in accordance with an ATR method, using Ge as an ATR crystal, and under a condition where an infrared light incidence angle is set to 45°; and Bl denotes a ratio of an intensity of a maximum absorption peak in a range from 1545 $cm^{-1}$ to 1555 $cm^{-1}$, assigned to —COOM contained in the polyolefin resin, with respect to an intensity of a maximum absorption peak in a range from 1713 $cm^{-1}$ to 1723 $cm^{-1}$, assigned to carbonyl in the polyester resin, in a FT-IR spectrum obtained through measurement of the first group in accordance with an ATR method, using diamond as an ATR crystal, and under a condition where an infrared light incidence angle is set to 45°.

A method of dividing the toner into a first group (a large particle size-side particle group) and into a second group (a small particle size-side particle group) will be described below. Both groups have a distribution pertaining to particle size and obey a relationship whereby a central particle size of the first group is larger than a central particle size of the second group. No relationship applies herein whereby the smallest particle included in the first group is larger than the largest particle included in the second group.

As pointed out above, small particle size side toners such as that disclosed in Japanese Patent Application Publication No. 2013-088686 exhibit a trade-off between image density stability and fogging suppression, and have thus room for improvement.

Therefore, the inventors further studied toners having superior image density stability and in which fogging can be suppressed. The inventors addressed separately, and in detail, the forces that act on toner in an electric field between a developer carrier and an electrostatic latent image bearing member. The charge quantity of toner, which affects electric field strength dependence, is proportional to the surface area, and accordingly decreases in proportion to the square of particle size. Meanwhile, non-electrostatic attachment forces on the electrostatic latent image bearing member are proportional to particle size, and hence reducing the particle size of toner results inevitably in lower developing performance, and in the occurrence of fogging.

Fogging can be suppressed by just increasing the charge quantity of conventionally proposed toners, in order to increase electric field flight forces in the toner; in this case, however, the image density stability merely decreases, and the above trade-off cannot be overcome. Further studies by the inventors have revealed that the main factor underlying the occurrence of fogging and the main factor underlying drops in image density stability can be traced to particles of dissimilar particle size in the particle size distribution of the toner.

Specifically, the main factor underlying the occurrence of fogging is a fine powder having a low charge quantity per particle. Meanwhile, the main factor underlying drops in image density stability is charge quantity per mass, which is influenced by a coarse powder of large mass per particle. It has therefore been found that taking measures aimed at the charge quantity of respective particle sizes results in a sharper charge distribution, and the above trade-off can be overcome.

The toner contains a toner particle containing a polyolefin resin having —COOM, which is a neutralized carboxy group with a monovalent metal ion M.

The polyolefin resin having —COOM is a polymer in which a vinyl polymer is bonded to a polyolefin. The content ratio of monomer units containing —COOM in the polyolefin resin having —COOM is from 1 mass % to 20 mass %.

The polymer in which a vinyl polymer is bonded to a polyolefin is preferably a polymer in which a vinyl polymer is graft-polymerized to a polyolefin.

By setting of the proportion of —COOM to be 1 mass % or more, —COOM adsorbs moisture in the atmosphere in high-temperature high-humidity environments, and readily dissociates as a carbonyl anion, which results in improved charging performance. By setting the content ratio to 20 mass % or less, charge-up in low-humidity environments can be suppressed, so that electrostatic attachment forces are reduced and developing performance is improved as a result.

The content ratio of monomer units containing —COOM in the polyolefin resin having —COOM is preferably from 6 mass % to 20 mass %, more preferably from 12 mass % to 20 mass %.

The term monomer unit denotes a form resulting from reaction of a monomer substance in a polymer.

The monomer units containing —COOM is preferably contained in a vinyl polymer. Preferably, the monomer unit in the vinyl polymer is each one carbon-carbon bond section within a main chain, of the polymer, resulting from polymerization of vinylic monomers.

The vinylic monomers can be preferably represented by Formula (A) below.

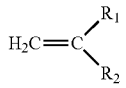

(A)

(In Formula (A), $R_1$ represents a hydrogen atom or an alkyl group (preferably, a C1 to C3 alkyl group, and more preferably, a methyl group) and $R_2$ represents an arbitrary substituent.)

As a characterizing feature, the polyolefin resin having —COOM and having the above characterizing charging characteristics becomes concentrated to a greater extent, in the vicinity of surfaces of particles in the second group than in the vicinity of surfaces of particles in the first group.

The charge quantity having the second group, having a low charge quantity per particle, can be made relatively higher as a result, which in turn allows making sharper the charge distribution of the toner.

Specifically, Expression (1) below is satisfied for the first group and for the second group, $$1.10 \leq (As/Bs)/(Al/Bl) \leq 2.00 \quad (1)$$

wherein As denotes a ratio of the intensity of a maximum absorption peak in a range from 1545 $cm^{-1}$ to 1555 $cm^{-1}$, assigned to —COOM contained in the polyolefin resin, with respect to the intensity of a maximum absorption peak in a range from 1713 $cm^{-1}$ to 1723 $cm^{-1}$, assigned to carbonyl in the polyester resin, in a FT-IR spectrum obtained through measurement of the second group in accordance with an ATR method, using Ge as an ATR crystal, and under a condition where an infrared light incidence angle is set to 45°;

Bs denotes a ratio of the intensity of a maximum absorption peak in a range from 1545 $cm^{-1}$ to 1555 $cm^{-1}$, assigned to —COOM contained in the polyolefin resin, with respect to the intensity of a maximum absorption peak in a range from 1713 $cm^{-1}$ to 1723 $cm^{-1}$, assigned to carbonyl in the polyester resin, in a FT-IR spectrum obtained through measurement of the second group in accordance with an ATR method, using diamond as an ATR crystal, and under a condition where an infrared light incidence angle is set to 45°;

Al denotes a ratio of the intensity of a maximum absorption peak in a range from 1545 $cm^{-1}$ to 1555 $cm^{-1}$, assigned to —COOM contained in the polyolefin resin with respect to the intensity of a maximum absorption peak in a range from 1713 $cm^{-1}$ to 1723 $cm^{-1}$, assigned to carbonyl in the polyester resin, in a FT-IR spectrum obtained through measurement of the first group in accordance with an ATR method, using Ge as an ATR crystal, and under a condition where an infrared light incidence angle is set to 45°; and Bl denotes a ratio of the intensity of a maximum absorption peak in a range from 1545 $cm^{-1}$ to 1555 $cm^{-1}$, assigned to —COOM contained in the polyolefin resin, with respect to the intensity of a maximum absorption peak in a range from 1713 $cm^{-1}$ to 1723 $cm^{-1}$, assigned to carbonyl in the polyester resin, in a FT-IR spectrum obtained through measurement of the first group in accordance with an ATR method, using diamond as an ATR crystal, and under a condition where an infrared light incidence angle is set to 45°.

Herein As (measurement of the second group in the toner) and Al (measurement of the first group in the toner) are indices pertaining to the abundance ratio of the polyolefin resin having —COOM with respect to the polyester resin, at about 0.3 μm from the toner surface in the depth direction of the toner, being a direction from the toner surface towards a central portion of the toner.

Meanwhile, Bs and Bl are indices pertaining to the abundance ratio of the polyolefin resin having —COOM with respect to the polyester resin, at about 1.0 μm from the toner surface in the depth direction.

Given that As/Bs is a coefficient pertaining to a ratio of a composition distribution with respect to the depth direction from the toner surface, then a value of the coefficient being higher than 1.00 signifies that the polyolefin resin having —COOM is more concentrated in the vicinity of the surface.

Therefore, a value of 1.10 or higher of a ratio of As/Bs with respect to Al/Bl signifies herein that a resin that improves the above charging performance can be concentrated in the vicinity of the surface of toner having a small particle size, among the toner groups.

As a result, the charge quantity of particles in the second group, having a low charge quantity per particle, can be made relatively higher, which in turn allows the charge distribution of the toner to be made sharp.

By setting on the other hand the ratio of As/Bs relative to Al/Bl to 2.00 or less, the charge quantity of toner on the small particle size side can be prevented from becoming excessively high, and the charge distribution can be made sharper.

The ratio (As/Bs)/(Al/Bl) lies preferably in the range from 1.50 to 2.00, more preferably from 1.75 to 2.00.

A sufficient effect can be achieved so long as the provisions of the present invention are satisfied by groups resulting from dividing in two so that the difference between the numbers of particles of the first group and of the second group is 4% or less. Accordingly, the wording "substantially equal" in the present invention signifies division in two so that the difference in the numbers of particles is 4% or less.

The method for calculating As, Bs, Al and Bl is as follows.

Firstly the toner is divided into two substantially equal parts, on a number basis, corresponding to a first group (a large particle size-side particle group) and a second group (a small particle size-side particle group), using an Elbow-jet classifier (by Nittetsu Mining Co., Ltd.) of an inertial classification system.

To divide the toner in two, a feed amount/fine powder classification edge being an operation condition of the Elbow-jet is optimized, and a coarse powder classification edge is closed at maximum, to thereby divide the toner into two substantially equal parts, corresponding a first group and into a second group. The specific method is described next.

To set the operation conditions of the Elbow-jet, firstly an air quantity control valve is adjusted so that air flow is identical on the large particle size side and on the small particle size side, and then the fine powder classification edge is moved, to work out a position at which a difference in the numbers of particles distributed between the large particle size side and the small particle size side is about 8%. Thereafter, the fine powder classification edge is fixed at that position, and the air quantity control valves on the large particle size side and the small particle size side are fine-tuned, to adjust the first group and the second group so as to divide the toner into two substantially equal parts, on a number basis (so that a difference in the numbers of respective particles is 4% or less). At this time for instance the feed amount can be set to 5 kg/hr, and the distance between the wall within the Elbow-jet on the fine powder passage side and the tip of the fine powder classification edge is 10 mm to 15 mm.

Next, the above ratios can be calculated by performing the below-described ATR measurements for the classified first group and second group In an ATR (Attenuated Total Reflection) method, a sample is brought into close contact with a crystal (ATR crystal) of higher refractive index than that of the sample, and infrared light is caused to strike the crystal at an incidence angle equal to or greater than a critical angle. Thereupon, the incident light repeatedly undergoes total reflection at the interface between the crystal and the sample closely adhered thereto, and exits then the crystal. Instead of being reflected at the interface between the sample and the crystal, thus, the infrared light becomes totally reflected after having penetrated somewhat into the sample. This penetration depth depends on the wavelength, the incidence angle, and the refractive index of the ATR crystal.

$$d_p=\lambda(2\pi n_1)\times[\sin^2\theta-(n_1/n_2)^2]^{-1/2}$$

$d_p$: penetration depth $n_1$: refractive index of sample (1.5 in the present invention)

$n_2$: refractive index of ATR crystal (4.0 in a case where the ATR crystal is Ge, 2.4 in a case where the ATR crystal is diamond)

θ: incidence angle

Accordingly, FT-IR spectra at different penetration depths can be obtained by modifying the refractive index and the incidence angle of the ATR crystal. This characteristic is exploited to determine an index pertaining to the abundance ratio of the polyolefin resin having a carboxy group (—COOM group) neutralized with a monovalent metal ion M in the vicinity of the toner surface. The degree of uneven distribution of the polyolefin resin having —COOM in the depth direction of the toner, from the toner surface toward the central portion of the toner, is thus quantified as an index In a case where in the ATR method Ge ($n_2$=4.0) is used as the ATR crystal, under conditions of light of 2000 $cm^{-1}$ (λ=5 μm) and incidence angle of 45°, the above expression yields a penetration depth $d_p$ of about 0.3 μm. On the other hand the penetration depth is about 1.0 μm in a case where diamond ($n_2$=2.4) is used as the ATR crystal, with a measurement under a condition of incidence angle of 45°.

Specifically a maximum absorption peak intensity in the range from 1545 $cm^{-1}$ to 1555 $cm^{-1}$, taking 1.00 as the maximum absorption peak intensity in the range from 1713 $cm^{-1}$ to 1723 $cm^{-1}$, in an FT-IR spectrum of the toner obtained through measurement relying on the ATR method, and using Ge ($n_2$=4.0) as the ATR crystal, under conditions of 45° as the infrared light incidence angle, is herein As (for particles in the second group) and Al (for particles in the first group).

Further, a maximum absorption peak intensity in the range from 1545 $cm^{-1}$ to 1555 $cm^{-1}$, taking 1.00 as the maximum absorption peak intensity in the range from 1713 $cm^{-1}$ to 1723 $cm^{-1}$, in an FT-IR spectrum of the toner obtained through measurement relying on the ATR method, and using diamond as the ATR crystal, under conditions of 45° as the infrared light incidence angle, is herein Bs (for particles in the second group) and Bl (for particles in the first group).

The maximum absorption peak in the range from 1713 $cm^{-1}$ to 1723 $cm^{-1}$ derives from stretching vibration of —CO—, being a carbonyl group in the polyester resin. In the polyolefin resin having —COOM, the peak derived from stretching vibration of —CO—, which is a carbonyl group, is shifted as a result of ionization, as described below.

In the FT-IR spectrum obtained through measurement of toner, accordingly, this peak does not derive from the polyolefin resin having —COOM; even if so, the contribution of the polyolefin resin having —COOM is slight and thus the peak is regarded as deriving from a component in the toner other than the polyolefin resin having —COOM.

Therefore, the spectrum is normalized so that the above peak is 1.00, whereupon the abundance ratio of the polyolefin resin having —COOM in the measurement region can be evaluated using the maximum absorption peak in the range from 1545 $cm^{-1}$ to 1555 $cm^{-1}$.

The maximum absorption peak in the range from 1545 $cm^{-1}$ to 1555 $cm^{-1}$ derives from stretching vibration of —CO— being an ionized carbonyl group in the polyolefin resin having —COOM. The larger this peak, the higher the abundance ratio of the polyolefin resin that is denoted thereby.

Herein, As is preferably 0.040 to 0.100, more preferably 0.060 to 0.090. Further, Bs is preferably 0.010 to 0.060, more preferably 0.040 to 0.050. Further, Al is preferably 0.01 to 0.08, more preferably 0.01 to 0.03. Next, Bl is preferably 0.01 to 0.05, more preferably 0.01 to 0.03.

The ratio As/Bs is preferably 1.05 to 2.00, more preferably 1.50 to 1.95. The ratio Al/Bl is preferably 0.50 to 1.50, more preferably 0.50 to 1.10.

Methods such as those described below may be illustrated as means for causing the polyolefin resin having —COOM to be present to greater extent in the vicinity of the surfaces of particles in the second group than in the vicinity of the surfaces of particles in the first group. For instance, such a method may involve modifying the addition amount of the polyolefin resin having —COOM, for imparting charge retention properties, between large particle size side toner and small particle size side toner, or may be a method that involves modifying the abundance ratio at a surface layer between the large particle size side toner and the small particle size side toner, in a core-shell formation step.

A chemical toner production method such as emulsion aggregation can be used as the core-shell formation step; alternatively, a dry-type heat sphering production method may be resorted which relies on formation of a spontaneous shell layer as a result of a below-described thermal treatment. Among the foregoing, in a dry-type heat sphering production method, relying on formation of a spontaneous shell layer as a result of a thermal treatment, the polyolefin resin can be concentrated in the vicinity of the surface, with a diffusion distance that becomes shorter as the particle size of the toner decreases. As a result toner a can be obtained conveniently that satisfies the above prescriptions, without mixing toners produced in accordance with dissimilar formulations.

The number-basis median diameter D50 of the toner is preferably from 3.0 μm to 6.0 μm. A span value denoting the particle diameter distribution of the toner, and obtained in accordance with the Expression (2) below, is preferably from 0.20 to 0.80.

$$(D90-D10)/D50 \quad (2)$$

In Expression (2), D90 is the particle diameter of toner at which a cumulative number of particles in increasing order of particle diameter is 90%, while D10 is the particle diameter of toner at which a cumulative number of particles in increasing order of particle diameter is 10%.

Transferability is improved, and fogging suppressed, by virtue of the fact that D50 is 3.0 μm or larger. Meanwhile image quality is improved by virtue of the fact that D50 is 6.0 μm or smaller.

The effect of the present invention can be significantly brought about thanks to the span value being 0.20 or larger. Also, transferability is improved and fogging suppressed by virtue of the fact that the span value is 0.80 or smaller.

More preferably, D50 is from 3.0 μm to 5.5 μm, and yet more preferably from 3.0 μm to 5.0 μm. Yet better dot reproducibility is achieved and superior image quality is obtained as a result.

More preferably, the span value is from 0.40 to 0.70.

Herein D10, D50, and D90 can be measured using a particle diameter distribution analyzer (Coulter Multisizer III: by Beckman Coulter, Inc.) in accordance with the Coulter method.

The details are described further on.

D10, D50, and D90 of the toner particle are calculated by using a precision particle diameter distribution measuring apparatus "Coulter Counter Multisizer 3" (registered trademark, manufactured by Beckman Coulter, Inc.) equipped with a 100-μm aperture tube having a pore size and based on a pore electric resistance method and also the dedicated software "Beckman Coulter Multisizer 3 Version 3.51" (manufactured by Beckman Coulter, Inc.) for setting measurement conditions and performing measurement data analysis, performing the measurement with 25,000 effective measurement channels, and analyzing the measurement data.

A solution prepared by dissolving special grade sodium chloride in deionized water to a concentration of about 1% by mass, for example, "ISOTON II" (manufactured by Beckman Coulter, Inc.), can be used as the electrolytic aqueous solution to be used for measurements.

The dedicated software is set up in the following manner before the measurement and analysis.

The total count number in a control mode is set to 50,000 particles on a "CHANGE STANDARD MEASUREMENT METHOD (SOM) SCREEN" in the dedicated software, the number of measurements is set to 1, and a value obtained using "standard particles 10.0 μm" (manufactured by Beckman Coulter, Inc.) is set as a Kd value. The threshold and the noise level are automatically set by pressing the measurement button of the threshold/noise level. Further, the current is set to 1600 μA, the gain is set to 2, the electrolytic solution is set to ISOTON II, and "FLUSH OF APERTURE TUBE AFTER MEASUREMENT" is checked.

In the "PULSE TO PARTICLE DIAMETER CONVERSION SETTING SCREEN" of the dedicated software, the bin interval is set to a logarithmic particle diameter, the particle diameter bin is set to a 256-particle diameter bin, and a particle diameter range is set from 2 μm to 60 μm.

A specific measurement method is described (1) to (7) hereinbelow.

(1) Approximately 200 mL of the electrolytic aqueous solution is placed in a glass 250 mL round-bottom beaker dedicated to Multisizer 3, the beaker is set in a sample stand, and stirring with a stirrer rod is carried out counterclockwise at 24 rpm. Dirt and air bubbles in the aperture tube are removed by the "FLUSH OF APERTURE TUBE" function of the dedicated software.

(2) Approximately 30 ml of the electrolytic aqueous solution is placed in a glass 100 mL flat-bottom beaker. Then, about 0.3 mL of a diluted solution obtained by 3-fold mass dilution of "CONTAMINON N" (10% by mass aqueous solution of a neutral detergent for washing precision measuring instruments of pH 7 consisting of a nonionic surfactant, an anionic surfactant, and an organic builder, manufactured by Wako Pure Chemical Industries, Ltd.) with deionized water is added.

(3) A predetermined amount of deionized water is placed in the water tank of an ultrasonic disperser "Ultrasonic Dispersion System Tetora 150" (manufactured by Nikkaki Bios Co., Ltd.) with an electrical output of 120 W in which two oscillators with an oscillation frequency of 50 kHz are built in with a phase shift of 180 degrees, and about 2 mL of CONTAMINON N is added to the water tank.

(4) The beaker of (2) hereinabove is set in the beaker fixing hole of the ultrasonic disperser, and the ultrasonic disperser is actuated. Then, the height position of the beaker is adjusted so that the resonance state of the liquid surface of the electrolytic aqueous solution in the beaker is maximized.

(5) About 10 mg of the toner is added little by little to the electrolytic aqueous solution and dispersed therein in a state in which the electrolytic aqueous solution in the beaker of (4) hereinabove is irradiated with ultrasonic waves. Then, the ultrasonic dispersion process is further continued for 60 sec. In the ultrasonic dispersion, the water temperature in the water tank is appropriately adjusted to a temperature from 10° C. to 40° C.

(6) The electrolytic aqueous solution of (5) hereinabove in which the toner is dispersed is dropped by using a pipette into the round bottom beaker of (1) hereinabove which has been set in the sample stand, and the measurement concentration is adjusted to be about 5%. Then, measurement is conducted until the number of particles to be measured reaches 50,000.

(7) The measurement data are analyzed with the dedicated software provided with the device, and D10, D50, and D90 are calculated.

Preferably, Expression (3) below is satisfied, and more preferably Expression (3') below is satisfied, where $\sigma s$ denotes the absolute value of the average value of surface charge density of the second group in the toner, and $\sigma l$ denotes the absolute value of the average value of the surface charge density of the first group.

$$1.05 \leq \sigma s/\sigma l \leq 1.50 \quad (3)$$

$$1.15 \leq \sigma s/\sigma l \leq 1.45 \quad (3')$$

The surface charge density $\sigma$ of the toner can be measured in accordance with the following method.

As described above, the toner is divided into two substantially equal parts, on a number basis, corresponding to a large particle size side and a small particle size side, using an Elbow-jet classifier (by Nittetsu Mining Co., Ltd.), to yield a first group and a second group, then a respective surface charge density $\sigma$ is measured using the toner thus divided in two.

Firstly, in an environment at 23° C. and 50% RH, 0.7 g of the toner and 9.3 g of a standard carrier (N-01) of the Imaging Society of Japan are placed in a 50 ml resin bottle that is then shaken for 5 minutes at 200 rpm, using a YAYOI shaker, to triboelectrically charge the toner thereby. A charge quantity per toner particle, for each particle size, is then measured using a charge quantity distribution measuring device.

Herein an E-SPART Analyzer (by Hosokawa Micron Corporation) can be used for the measurement. The E-SPART Analyzer is a device in which sample particles are introduced into a detection unit (measuring unit) having simultaneously formed therein an electric field and an acoustic field, and in which the moving speed of particles is measured in accordance with a laser Doppler method, to thereby measure particle size and charge quantity.

The surface charge density $\sigma$ is then calculated from the charge quantity per toner particle, for each particle size, as obtained in the measurement. Specifically, the surface charge density $\sigma$ can be derived using the calculation expression below.

$$\sigma = Q\pi D^2$$

In the expression, Q is the amount of charge and D is a number-average particle diameter of the toner.

Fogging and drops in transferability caused by small particle size side toner can be suppressed, excessive increases in the toner charge quantity per unit mass caused by large particle size side toners can be curtailed, and image density stability can be improved, by virtue of the fact that the toner satisfies Expression (3).

A precision particle size distribution measuring device "Coulter Counter Multisizer 3" (registered trademark product name, by Beckman Coulter, Inc.) equipped with a 100 μm aperture tube can be used for measuring the number-average particle diameter of the toner. Ancillary dedicated software "Beckman Coulter Multisizer 3 Version 3.51" (by Beckman Coulter, Inc.) can be used for setting measurement conditions and analyzing measurement data.

The absolute value $\sigma s$ of the average value of surface charge density of particles in the second group satisfies preferably Expression (4) below, and more preferably satisfies Expression (4') below.

$$0.040 \leq \sigma s \quad (4)$$

$$0.045 \leq \sigma s \leq 0.065 \quad (4')$$

The amount of charge of particles in the second group is large by virtue of the fact that the toner satisfies Expression (4), and accordingly it becomes possible to reduce the amount of toner having a small electric field flight force, so that transferability is improved and fogging suppressed.

The absolute value $\sigma l$ of the average value of surface charge density of particles in the first group satisfies preferably Expression (5) below, and more preferably satisfies Expression (5') below.

$$\sigma l \leq 0.050 \quad (5)$$

$$0.035 \leq \sigma l \leq 0.045 \quad (5')$$

By virtue of the fact that the toner satisfies Expression (5), the amount of charge of particles in the first group does not become excessively large; as a result, the charge quantity per unit mass is not excessive, and thus image density stability can be accordingly improved.

An absolute value Qs of the average value of the amount of charge per toner particle of the second group is preferably 1.4 fC or larger. As a result, the quantity of particles having a small amount of charge can be reduced, transferability can be improved, and fogging can be suppressed.

An absolute value Ql of the average value of the amount of charge per toner particle of the first group is preferably 2.8 fC or smaller. As a result the charge quantity per mass of toner can be prevented from becoming excessively large, and image density stability is improved.

Preferably, the charge quantity per unit mass of the toner is 70 μC/g or less. Drops in image density can be suppressed as a result.

The charge quantity per unit mass of the toner can be measured for instance in accordance with the method described below.

Firstly, in an environment at 23° C. and 50% RH, 0.7 g of the toner and 9.3 g of a standard carrier (N-01) of the Imaging Society of Japan are placed in a 50 ml resin bottle that is then shaken for 5 minutes at 200 rpm, using a YAYOI shaker, to triboelectrically charge the toner thereby. Next, about 0.15 g of the triboelectrically charged toner is placed in a metal-made measuring container having a 635 mesh screen at the bottom, and the container is closed with a metal lid. The mass of the entire measuring container is weighed, as W1 (g).

The measuring container is evacuated next, through a suction port, in a suction device (such that at least a portion of the suction device in contact with the measuring container is an insulator), with a vacuum-gauge pressure being set to 1.5 kPa through adjustment of an air quantity control valve. In this state, the toner is removed by being thoroughly suctioned, preferably suctioned for 2 minutes. The amount of charge accumulated in a capacitor at this time is Q (μC). The mass of the entire measuring container after suction is weighed, as W2 (g). The charge quantity per unit weight of toner (μC/g) is obtained on the basis of the expression below.

Charge quantity per unit weight of toner (μC/g)=Q/(W1−W2)

The method for bonding the polyolefin and the vinyl polymer (preferably graft copolymerization) is not particularly limited, and a conventionally known method can be resorted to.

The monomer unit containing —COOM can be formed using a monomer that has a carboxy group. The monomer having a carboxy group has preferably ethylenically unsaturated bonds, more preferably has one ethylenically unsaturated bond.

Examples of the monomer having a carboxy group include acrylic acid, methacrylic acid, maleic acid, maleic anhydride and itaconic acid. Preferably the monomer includes acrylic acid and more preferably is acrylic acid, from the viewpoint of charging performance. The monomer may include a structure other than an acid group, so long as physical properties are not imparted thereby.

The monomer unit containing —COOM is preferably represented by Formula (C).

(C)

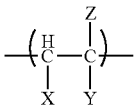

In the formula, X is a hydrogen atom or —COOM. Further, Y is —$(CH_2)_m$—COOM (where m is an integer from 0 to 3 (preferably 0 or 1, and more preferably 0)). Further, Z is a hydrogen atom, a C1 to C3 alkyl group (preferably a methyl group) or —COOM. The number of —COOM per unit of monomer units containing —COOM is preferably 1 or 2, and is more preferably 1.

Particularly preferably, X is a hydrogen atom, Y is —COOM, and Z is a hydrogen atom or a methyl group.

A polyolefin resin containing a carboxy group can be produced by eliciting bonding of a polyolefin to a vinyl polymer in accordance with a known method, using a monomer containing a carboxy group.

A polyolefin resin having —COOM is obtained through neutralization, by bringing the polyolefin resin containing a carboxy group into contact with an aqueous solution of a base such as sodium hydroxide. From the viewpoint of neutralization efficiency, in the neutralization step it is preferable to dissolve a copolymer in a water-soluble solvent, followed by neutralization through addition of an aqueous solution of a base such as sodium hydroxide. The polyolefin resin containing —COOM is obtained then by removing the solvent from the reaction solution resulting from the neutralization step.

Examples of the base include lithium hydroxide, sodium hydroxide, potassium hydroxide and the like, preferably lithium hydroxide. That is, the monovalent metal ion M is preferably at least one selected from the group consisting of $Li^+$, $Na^+$ and $K^+$, and is more preferably $Li^+$.

The term polyolefin resin having —COOM denotes a polymer in which a vinyl polymer is bonded to a polyolefin. Preferably, the vinyl polymer has a structure derived from a cycloalkyl (meth)acrylate. The term structure derived from a cycloalkyl (meth)acrylate denotes a structure, in the vinyl polymer, resulting from polymerization of an acryloyl group or methacryloyl group included in a cycloalkyl (meth) acrylate.

Preferably, the vinyl polymer is a polymer of a cycloalkyl (meth)acrylate, a vinylic monomer other than a cycloalkyl (meth)acrylate, and a monomer having a carboxy group. The carboxy group in the polymer is neutralized with a monovalent metal ion M.

Preferably a C3 to C18 saturated alicyclic hydrocarbon group, and more preferably a C4 to C12 saturated alicyclic hydrocarbon group, serves herein as the cycloalkyl group of the cycloalkyl (meth)acrylate. The saturated alicyclic hydrocarbon group encompasses for instance monocyclic saturated alicyclic hydrocarbon groups, condensed polycyclic hydrocarbon groups, bridged ring hydrocarbon groups and spiro hydrocarbon groups, Examples of saturated alicyclic hydrocarbon groups include a cyclopropyl group, a cyclobutyl group, a cyclopentyl group, a cyclohexyl group, a t-butylcyclohexyl group, a cycloheptyl group, a cyclooctyl group, a tricyclodecanyl group, a decahydro-2-naphthyl group, a tricyclo[$5.2.1.0^{2,6}$] decan-8-yl group, a pentacyclopentadecanyl group, an isobornyl group, an adamantyl group, a dicyclopentanyl group and a tricyclopentanyl group.

The saturated alicyclic hydrocarbon group can have an alkyl group, a halogen atom, a carboxy group, a carbonyl group, a hydroxyl group or the like as a substituent. Preferred as a substituent in the form of an alkyl group is herein a C1 to C4 alkyl group.

More preferable among these saturated alicyclic hydrocarbon groups are C3 to C18 monocyclic saturated alicyclic hydrocarbon groups, substituted or unsubstituted dicyclopentanyl groups, and substituted or unsubstituted tricyclopentanyl groups, while C6 to C10 cycloalkyl groups are yet more preferable, with a cyclohexyl group being particularly preferable herein.

The content of the structure derived from the cycloalkyl (meth)acrylate monomer in the vinyl polymer is preferably from 1 mass % to 10 mass %.

Preferably, the weight-average molecular weight (Mw) of the polyolefin resin having —COOM, in a molecular weight distribution by GPC, is from 5000 to 70000.

Another vinylic monomer other than a cycloalkyl (meth) acrylate can be used in the vinyl polymer. A monomer having one ethylenically unsaturated bond is preferred herein.

Examples thereof include acrylic acid and methacrylic acid; styrenic monomers such as styrene, α-methyl styrene, p-methyl styrene, m-methyl styrene, p-methoxy styrene, p-hydroxy styrene, p-acetoxy styrene, vinyltoluene, ethyl styrene, phenyl styrene and benzyl styrene; alkyl esters of unsaturated carboxylic acids (where the number of carbon atoms in the alkyl is from 1 to 18) such as methyl acrylate, ethyl acrylate, butyl acrylate, 2-ethylhexyl acrylate, methyl methacrylate, ethyl methacrylate, butyl methacrylate and 2-ethylhexyl methacrylate; vinyl ester type monomers such as vinyl acetate; vinyl ether type monomers such as vinyl methyl ether; halogen element-containing vinylic monomers such as vinyl chloride; and diene type monomers such as butadiene and isobutylene. These may be used as a plurality thereof.

Preferred herein are styrenic monomers and alkyl esters of unsaturated carboxylic acids.

The content ratio of the vinyl polymer in the polyolefin resin having —COOM is preferably from 80 mass % to 95 mass %, more preferably from 85 mass % to 95 mass %. Within such a range, the content of polyolefin exhibiting low affinity to the polyester resin as the binder resin can be reduced, and dispersion of the polyolefin in the toner can be made adequate; the charging characteristics of the derived from —COOM are improved as a result.

Suitable examples of the polyolefin include low molecular weight polyethylene, low molecular weight polypropylene, alkylene copolymers, and hydrocarbon waxes such as microcrystalline wax and paraffin wax.

Preferably, the polyolefin has a branched structure, as in polypropylene, from the viewpoint of reactivity during production of the polyolefin resin having —COOM.

Preferably, the content ratio of the polyolefin is from 5.0 mass % to 20.0 mass % in the polymer in which a vinyl polymer is bonded to a polyolefin.

The content of the polyolefin resin having —COOM is preferably from 3 parts by mass to 15 parts by mass, more preferably from 5 parts by mass to 15 parts by mass, with respect to 100 parts by mass of the binder resin.

Polyester Resin

The toner particle contains a binder resin that includes a polyester resin. The binder resin may contain a resin other than a polyester resin, so long as the effect of the present invention is not impaired thereby. The polyester resin is preferably an amorphous polyester resin.

A polyhydric alcohol (dihydric, trihydric or higher alcohol), and a polyhydric carboxylic acid (divalent, trivalent or higher carboxylic acid) as well as acid anhydrides and lower alkyl esters thereof, can be used as the monomers that are utilized in the polyester resin.

Examples of polyhydric alcohol monomers that can be used utilized in the polyester resin include the following polyhydric alcohol monomers.

Examples of the dihydric alcohol component include ethylene glycol, propylene glycol, 1,3-butanediol, 1,4-butanediol, 2,3-butanediol, diethylene glycol, triethylene glycol, 1,5-pentanediol, 6-hexanediol, neopentyl glycol, 2-ethyl-1,3-hexanediol, hydrogenated bisphenol A, bisphenol represented by formula (A) and derivatives thereof, and diols represented by formula (B).

(A)

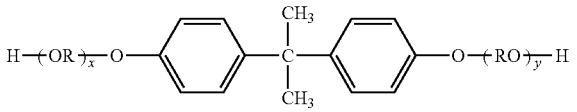

(in the formula (A), R is ethylene or propylene, x and y are each an integer of 0 or more, and the average value of x+y is from 0 to 10).

(B)

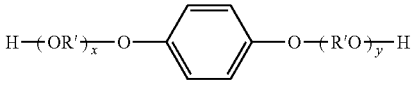

(in the formula (B), R' is —$CH_2CH_2$—, —$CH_2CH(CH_3)$—, or —$CH_2C(CH_3)_2$—; x and y are each an integer of 0 or more; and the average value of x+y is 0 to 10).

Examples of the trivalent or higher alcohol component include sorbitol, 1,2,3,6-hexanetetrol, 1,4-sorbitan, pentaerythritol, dipentaerythritol, tripentaerythritol, and 1,2,4-butanetriol. 1,2,5-pentanetriol, glycerol, 2-methylpropanetriol, 2-methyl-1,2,4-butanetriol, trimethylolethane, trimethylolpropane, and 1,3,5-trihydroxymethylbenzene.

Among these, glycerol, trimethylolpropane and pentaerythritol are preferably used. These dihydric alcohols and trihydric or higher alcohols may be used singly or in combination of a plurality thereof.

The following polyvalent carboxylic acid monomers can be used as a polyvalent carboxylic acid monomer used for the polyester resin.

Examples of the divalent carboxylic acid component include maleic acid, fumaric acid, citraconic acid, itaconic acid, glutaconic acid, phthalic acid, isophthalic acid, terephthalic acid, succinic acid, adipic acid, sebacic acid, azelaic acid, malonic acid, n-dodecenylsuccinic acid, isododecenylsuccinic acid, n-dodecyl succinic acid, isododecylsuccinic acid, n-octenylsuccinic acid, n-octylsuccinic acid, isooctenylsuccinic acid, isooctylsuccinic acid, anhydrides of these acids, lower alkyl esters thereof and the like.

Among these, maleic acid, fumaric acid, terephthalic acid and n-dodecenyl succinic acid are preferably used.

Examples of the trivalent or higher carboxylic acid, acid anhydrides thereof and lower alkyl esters thereof include 1,2,4-benzenetricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, 1,2,4-cyclohexanetricarboxylic acid, tetra(methylenecarboxyl) methane, 1,2,7,8-octanetetracarboxylic acid, pyromellitic acid, Empol trimer acid, acid anhydrides thereof and lower alkyl esters thereof.

Among these, 1,2,4-benzenetricarboxylic acid, that is, trimellitic acid or a derivative thereof is particularly preferably used because it is inexpensive and the reaction control is easy. These divalent carboxylic acids and the like and trivalent or higher carboxylic acids can be used alone or in combination of a plurality thereof.

A method for producing the polyester resin is not particularly limited, and known methods can be used. For example, the above-mentioned alcohol monomer and carboxylic acid monomer are simultaneously charged and polymerized through an esterification reaction or a transesterification reaction and a condensation reaction to produce a polyester resin.

The polymerization temperature is not particularly limited, but is preferably in the range of from 180° C. to 290° C. In the polymerization of the polyester resin, for example, a polymerization catalyst such as a titanium-based catalyst, a tin-based catalyst, zinc acetate, antimony trioxide, germanium dioxide or the like can be used. In particular, when the binder resin is an amorphous resin, the amorphous resin is more preferably a polyester resin polymerized using a tin-based catalyst.

The acid value of the polyester resin is preferably from 5 mg KOH/g to 20 mg KOH/g, and the hydroxyl value is preferably from 20 mg KOH/g to 70 mg KOH/g. Within the above ranges, the amount of adsorbed moisture under a high-temperature and high-humidity environment can be suppressed and the non-electrostatic attachment force can be suppressed to a low level, which is preferable from the viewpoint of suppressing fogging.

The polyester resin may be used by mixing a low molecular weight resin and a high molecular weight resin. From the viewpoint of low-temperature fixability and hot offset resistance, the content ratio of the low molecular weight resin with respect to the high molecular weight resin is preferably from 40/60 to 85/15 on a mass basis.

The term low molecular weight refers herein for instance to a weight-average molecular weight in the range from 1500 to 10000. The term high molecular weight refers herein for instance to a weight-average molecular weight in the range from 15000 to 500000.

Release Agent (Wax)

A wax can be used as a release agent in the toner particle. Examples include the following.

Hydrocarbon waxes such as low molecular weight polyethylene, low molecular weight polypropylene, alkylene copolymers, microcrystalline wax, paraffin wax, and Fischer-Tropsch wax; oxides of hydrocarbon waxes such as oxidized polyethylene wax or block copolymers thereof; waxes based on fatty acid esters such as carnauba wax; partially or entirely deoxidized fatty acid esters such as deoxidized carnauba wax. Further, the following may be mentioned.

Saturated linear fatty acids such as palmitic acid, stearic acid and montanic acid; unsaturated fatty acids such as brassidic acid, eleostearic acid and parinaric acid; saturated alcohols such as stearyl alcohol, aralkyl alcohol, behenyl alcohol, carnaubyl alcohol, ceryl alcohol, and melissyl alcohol; polyhydric alcohols such as sorbitol; esters of fatty acids such as palmitic acid, stearic acid, behenic acid, and montanic acid with alcohols such as stearyl alcohol, aralkyl alcohol, behenyl alcohol, carnaubyl alcohol, ceryl alcohol, and melissyl alcohol; fatty acid amides such as linoleic acid amide, oleic acid amide, and lauric acid amide; saturated fatty acid bisamides such as methylene bis(stearic acid amide), ethylene bis(capric acid amide), ethylene bis(lauric acid amide), and hexamethylene bis(stearic acid amide); unsaturated fatty acid amides such as ethylene bis(oleic acid amide), hexamethylene bis(oleic acid amide), N,N'-dioleyl adipic acid amide, and N,N'-dioleyl sebacic acid amide; aromatic bisamides such as m-xylene bis(stearic acid amide) and N,N'-distearyl isophthalic acid amide; metal salt of fatty acid such as calcium stearate, calcium laurate, zinc stearate, and magnesium stearate (generally referred to as metal soaps); waxes obtained by grafting aliphatic hydrocarbon waxes by using vinyl monomers such as styrene and acrylic acid; partial esterification products of fatty acids with polyhydric alcohols such as monoglyceride behenate; and methyl ester compounds having a hydroxyl group which are obtained by hydrogenation of vegetable fats and oils.

Among these waxes, from the viewpoint of improving low-temperature fixability and fixation separability, hydrocarbon waxes such as paraffin wax and Fischer-Tropsch wax, and fatty acid ester waxes such as carnauba wax are preferable. Hydrocarbon waxes are more preferable in that the hot offset resistance is further improved.

The content of the wax is preferably 3 parts by mass to 8 parts by mass with respect to 100 parts by mass of the binder resin.

Further, in the endothermic curve at the time of temperature rise measured with a differential scanning calorimetry (DSC) device, the peak temperature of the maximum endothermic peak of the wax is preferably from 45° C. to 140° C. This range of the peak temperature of the maximum endothermic peak of the wax is preferable because both the storage stability of the toner and the hot offset resistance can be achieved.

Colorant

The toner particle may contain a colorant. Known colorants can be used herein.

The content of the colorant is preferably from 0.1 parts by mass to 30.0 parts by mass, with respect to 100 parts by mass of the binder resin.

Inorganic Fine Particles

The toner may contain inorganic fine particles, as needed. The inorganic fine particles may be internally added to the toner particle, or may be mixed with the toner particle as an external additive.

Inorganic fine particle of for instance silica, aluminum oxide, titanium oxide and strontium titanate are preferable as an external additive. Inorganic fine particles having a specific surface area from 50 $m^2/g$ to 400 $m^2/g$ are preferred as an external additive for enhancing flowability. Preferably, the inorganic fine particles are hydrophobized using a hydrophobic agent such as a silane compound, a silicone oil or a mixture of the foregoing, from the viewpoint of suppressing drops in the charging ability of the external additive in high-humidity environments.

The toner particle and the external additive can be mixed using a known mixer such as a Henschel mixer. The content of the external additive is preferably from 0.1 parts by mass to 10.0 parts by mass, with respect to 100 parts by mass of the toner particle.

Developer

The toner can be used as a one-component developer, but can be used also as a two-component developer, by being mixed with a magnetic carrier, for the purpose of further improving dot reproducibility, and for the purpose of supplying a stable image over long periods of time.

Magnetic carriers include generally known materials such as, for example, iron oxide; metal particles such as iron, lithium, calcium, magnesium, nickel, copper, zinc, cobalt, manganese, chromium and rare earths, alloy particles thereof, and oxide particles thereof; magnetic bodies such as ferrites; magnetic body-dispersed resin carriers (the so-called resin carriers) including a binder resin in which the magnetic bodies are held in a dispersed state; and the like.

When the toner is mixed with a magnetic carrier and used as a two-component developer, the mixing ratio of the magnetic carrier at that time is preferably from 2% by mass to 15% by mass, and more preferably 4% by mass to 13% by mass as the toner concentration in the two-component developer.

Toner Production Method

The method of producing a toner particle is not particularly limited, but a pulverization method in which a surface constitutes a hydrophobic structure is preferred herein, from the viewpoint of charging performance in high-temperature high-humidity environments. That is, the toner particle is preferably a pulverized toner particle. By resorting to a pulverization method, a highly hydrophobic release agent and a polyolefin resin having —COOM are readily caused to be disposed in the vicinity of the surface of the toner particle. A core-shell structure by a thermal treatment device is readily formed as a result.

A toner production procedure in a pulverization method will be explained next.

The toner production method includes a step of obtaining a kneaded product by melt-kneading a resin composition containing a binder resin including a polyester resin and a polyolefin resin having —COOM;

- a step of obtaining a cooled product by cooling the kneaded product;
- a step of obtaining a toner particle by pulverizing the cooled product; and
- a step of subjecting the toner particle to a thermal treatment by a hot air current, wherein the hot air current preferably has a temperature of 110° C. or higher.

In a starting material mixing step, for instance a binder resin including a polyester resin, a polyolefin resin having —COOM, as the materials that make up the toner particle, and as needed other components such as a release agent, a colorant, a plasticizer, a charge control agent and so forth, are weighed in predetermined amounts, and are blended and mixed, to yield a resin composition.

Examples of the mixing apparatus include a double-cone mixer, a V-type mixer, a drum mixer, a super mixer, a Henschel mixer, a NAUTA mixer, and a MECHANO HYBRID (manufactured by Nippon Coke Industry Co., Ltd.).

Next, the mixed resin composition is melt-kneaded to obtain the kneaded product where the materials are dispersed in the binder resin. In the melt-kneading process, a batch-type kneader such as a pressure kneader or a Banbury mixer, or a continuous-type kneader can be used, and a single- or twin-screw extruder is preferably used because of its superiority of continuous production.

Specific examples of the single- or twin-screw extruder include a KTK type twin-screw extruder (manufactured by Kobe Steel, Ltd.), a TEM type twin-screw extruder (manufactured by Toshiba Machine Co., Ltd.), a PCM kneader (made by Ikegai Corp.), a twin-screw extruder (manufactured by KCK Co.), Co-Kneader (manufactured by Buss AG) and KNEADEX (manufactured by Nippon Coke & Engineering Co., Ltd.).

Furthermore, the resin composition obtained by melt-kneading may be rolled with a two-roll mill or the like, and may be cooled with water or the like in the cooling step.

The cooled product obtained by cooling is then pulverized to the desired particle size in the pulverization step. In the pulverization step, coarse pulverization is performed with a pulverizing device such as, for example, a crusher, a hammer mill, or a feather mill. Thereafter, for example, the material is finely pulverized by a KRYPTON system (manufactured by Kawasaki Heavy Industries, Ltd.), SUPER ROTOR (manufactured by Nisshin Engineering Co., Ltd.), TURBO MILL (manufactured by Turbo Kogyo) or an air jet type fine pulverizing device to obtain the toner particle.

The toner particle is next classified as needed using a classifier or a sieving machine. Examples of classifiers and sieving machines include for instance the following. An Elbow-jet inertial classification system (by Nittetsu Mining Co., Ltd.), a centrifugal classification system Turboplex (by Hosokawa Micron Corporation), a TSP separator (by Hosokawa Micron Corporation), and FACULTY (by Hosokawa Micron Corporation).

Thereafter, the toner particle may be surface-treated by heating, to increase the circularity of the toner. For instance, a surface treatment by a hot air current can be carried out using the heat sphering treatment device illustrated in the FIGURE.

A surface treatment using the heat sphering treatment device illustrated in the FIGURE will be explained next.

A mixture quantitatively supplied by a raw material quantitative supply means 1 is introduced to an introduction pipe 3 by a compressed gas adjusted by a compressed gas adjustment means 2. The mixture that has passed through the introduction pipe 3 is uniformly dispersed by a conical projection-shaped member 4 provided at the center of the longitudinal direction of the introduction pipe 3, and is introduced into the radially extending eight-direction supply pipes 5 to be introduced into a treatment chamber 6 where the heat treatment is performed.

At this time, the flow of the mixture supplied to the treatment chamber 6 is regulated by a regulation means 9 provided in the treatment chamber 6 for regulating the flow of the mixture. For this reason, the mixture supplied to the treatment chamber 6 is cooled after being heat-treated while swirling in the treatment chamber 6.

Hot air for heat-treating the supplied mixture is supplied from the hot air supply means 7, and is swirled and introduced into the treatment chamber 6 by a swirling member 13 for swirling the hot air. As a specific configuration, the swirling member 13 for swirling the hot air may have a plurality of blades, and the swirling of the hot air can be controlled by the number and angle of the blades.

The temperature of the hot air supplied into the treatment chamber 6 at the outlet of the hot air supply means 7 is preferably at least 100° C., more preferably at least 110° C., and even more preferably at least 130° C. The upper limit is preferably 300° C. or less. Where the temperature at the outlet of the hot air supply means 7 is within the above range, the toner particles can be uniformly spheroidized while preventing fusion or coalescence of the toner particles due to excessive heating of the mixture.

Further, the heat-treated toner particles subjected to the heat treatment are cooled by the cold air supplied from a cold air supply means 8 (8-1, 8-2, 8-3), and the temperature supplied from the cold air supply means 8 is preferably −20° C. to 30° C. Where the temperature of the cold air is within the above range, the heat-treated toner particles can be efficiently cooled, and fusion or coalescence of the heat-treated toner particles can be prevented without inhibiting uniform spheroidization of the mixture. The absolute moisture content of the cold air is preferably from 0.5 $g/m^3$ to 15.0 $g/m^3$.

Next, the cooled heat-treated toner particles are collected by a collection means 10 at the lower end of the treatment chamber 6. A blower (not shown) is provided at the end of the collection means 10 and configured to ensure suction and transportation of the toner particles.

Further, a powder particle supply port 14 is provided such that the swirling direction of the supplied mixture and the swirling direction of the hot air are the same, and the collection means 10 of the heat sphering treatment apparatus is provided on the outer periphery of the treatment chamber 6 so as to maintain the swirling direction of the swirled powder particles. Furthermore, the cold air supplied from the cold air supply means 8 is supplied horizontally and tangentially from the outer peripheral portion of the apparatus to the peripheral surface of the treatment chamber.

The swirling direction of the toner particles supplied from the powder supply port, the swirling direction of the cold air supplied from the cold air supply means 8, and the swirling direction of the hot air supplied from the hot air supply means 7 are all the same. Therefore, no turbulent flow occurs in the treatment chamber 6, the swirling flow in the apparatus is enhanced, strong centrifugal force is applied to the toner particles, and the dispersibility of the toner particles is further improved. As a result, toner particles including few coalesced particles and having uniform shape can be obtained.

In terms of suppressing fogging, a range from 0.960 to 0.980 as the average circularity of the toner particle is preferable, since within that range non-electrostatic attachment forces can be kept low.

Thereafter, the toner can be divided in two as needed, into a fine powder toner and a coarse powder toner. For instance, the toner can be divided in two using an Elbow-jet inertial classification system (by Nittetsu Mining Co., Ltd.). An arbitrary fine powder toner and an arbitrary coarse powder toner may be mixed in order to achieve desired physical properties. The obtained toner particle may be used, as-is, as the toner; alternatively, the toner particle may be used as the toner after inorganic fine particles such as silica have been externally added to the toner particle.

Methods that involve performing an external addition treatment include for instance a method of stirring/mixing using a mixing device as an external addition machine. Examples of mixing devices include the following. A double-cone mixer, a V-shaped mixer, a drum mixer, a Super mixer, a Henschel mixer, a Nauta mixer, a Mechano Hybrid (by Nippon Coke & Engineering Co., Ltd.) and Nobilta (by Hosokawa Micron Corporation). An external addition treatment with an external additive other than silica fine particles, for instance a fluidizing agent, may be carried out at this time as needed.

EXAMPLES

The present invention will be explained next in further detail based on examples and comparative examples, but implementations of the present invention are not limited to these examples. In the examples and comparative examples, numerical values of "parts" are based on parts by mass in all instances, unless otherwise noted.

Measurement methods of the various physical properties will be explained next.

FT-IR Spectrum Measurement of Toner (Calculation of As, Al, Bs and Bl)

As samples there are used a first group and a second group obtained by dividing a toner into two substantially equal parts, on a number basis, into a large particle size side and a small particle size side, using an Elbow-jet classifier (by Nittetsu Mining Co., Ltd.) of an inertial classification system, as described above.

Herein the FT-IR spectrum of the toner is measured in accordance with an ATR method, using a Fourier-transform infrared spectroscopic analyzer (product name: Spectrum One, by PerkinElmer, Inc.) equipped with a universal ATR measurement accessory (Universal ATR Sampling Accessory). The specific measurement procedure and the method for calculating As, Al, Bs and Bl are as follows.

The incidence angle of infrared light ($\lambda$=5 μm) is set to 45°. Further, an ATR crystal (refractive index=4.0) of Ge or an ATR crystal (refractive index=2.4) of diamond is used as the ATR crystal. Other conditions are as follows.

Range
Start: 4000 $cm^{-1}$
End: 600 $cm^{-1}$ (Ge ATR crystal)
400 $cm^{-1}$ (diamond ATR crystal)
Duration
Scan number: 16
Resolution: 4.00 $cm^{-1}$
Advanced: $CO_2/H_2O$ corrected (1) The Ge ATR crystal (refractive index=4.0) is set in the device.
(2) Scan type is then set to Background, Units is set to EGY, and the background is measured.
(3) Scan type is then set to Sample and Units is set to A.
(4) Then 0.01 g of toner are weighed exactly on the ATR crystal.
(5) The sample is pressed using a pressure arm (Force Gauge of 100).
(6) The sample is measured.
(7) The obtained FT-IR spectrum is subjected to base line correction with Automatic Correction.
(8) A respective maximum absorption peak intensity in the range from 1545 $cm^{-1}$ to 1555 $cm^{-1}$ is calculated, and is divided by a respective range from 1713 $cm^{-1}$ to 1723 $cm^{-1}$, to calculate As and Al.
(9) The measurement is carried out in accordance with the same method also for a diamond crystal, to calculate Bs and Bl Measurement by GPC of the Peak Molecular Weight and Weight-average molecular weight of the polyester resin and the polyolefin resin having a carboxy group —COOM neutralized with a monovalent metal ion M The molecular weight distribution of the THF soluble matter of the resin is measured by gel permeation chromatography (GPC) in the following manner.

First, the toner is dissolved in tetrahydrofuran (THF) for 24 h at room temperature. Then, the resulting solution is filtered through a solvent-resistant membrane filter "MAESHORI DISK" (manufactured by Tosoh Corporation) having a pore diameter of 0.2 μm to obtain a sample solution. The sample solution is adjusted so that the concentration of the components soluble in THF is about 0.8% by mass. The measurement is performed under the following conditions by using this sample solution.

Device: HLC8120 GPC (detector: RI) (manufactured by Tosoh Corporation)
Column: 7 series of Shodex KF-801, 802, 803, 804, 805, 806, 807 (manufactured by Showa Denko K. K.)
Eluent: tetrahydrofuran (THF)
Flow rate: 1.0 ml/min
Oven temperature: 40.0° C.
Sample injection volume: 0.10 ml When calculating the molecular weight of the sample, a molecular weight calibration curve prepared using a standard polystyrene resin (for example, trade name "TSK standard polystyrene F-850, F-450, F-288, F-128, F-80, F-40, F-20, F- 10, F-4, F-2, F-1, A-5000, A-2500, A-1000, A-500", manufactured by Tosoh Corporation) is used.

Method for Measuring the Softening Point of the Polyester Resin and of the Polyolefin Resin Having —COOM The measurement of the softening point is carried out using a constant-load extrusion type capillary rheometer "Flow Characteristic Evaluation Apparatus Flow Tester CFT-500D" (manufactured by Shimadzu Corporation) according to the manual provided with the apparatus. In this apparatus, the temperature of the measurement sample filled in the cylinder is raised and the sample is melted while applying a constant load with a piston from the top of the measurement sample, the melted measurement sample is extruded from a die at the bottom of the cylinder, and a flow curve showing the relationship between the piston descent amount and temperature at this time can be obtained.

The "melting temperature in the ½ method" described in the manual provided with the "Flow Characteristic Evaluation Apparatus Flow Tester CFT-500D" is taken as the softening point. The melting temperature in the ½ method is calculated in the following manner. First, a half of the difference between the descent amount of Smax of the piston at the end of the outflow and the descent amount Smin of the piston at the start of the outflow is determined (this is taken as X. X=(Smax−Smin)/2). The temperature at the time the descent amount of the piston in the flow curve is the sum of X and Smin is the melting temperature in the ½ method.

The measurement sample is prepared by compression molding about 1.0 g of the resin into a cylinder with a diameter of about 8 mm at about 10 MPa for about 60 sec under an environment at 25° C. by using a tablet press (for example, NT-100H, manufactured by NPA Systems Inc.).

The measurement conditions of CFT-500D are as follows.

Test mode: temperature rising method
Starting temperature: 50° C.
Reached temperature: 200° C.
Measurement interval: 1.0° C.
Heating rate: 4.0° C./min
Piston cross-sectional area: 1.000 $cm^2$
Test load (piston load): 10.0 kgf (0.9807 MPa)
Preheating time: 300 sec
Die hole diameter: 1.0 mm
Die length: 1.0 mm Measurement of the Glass Transition Temperature (Tg) of the Polyester Resin and of the Polyolefin Resin Having —COOM The glass transition temperature and the melting peak temperature are measured according to ASTM D3418-82 by using a differential scanning calorimeter "Q2000" (manufactured by TA Instruments).

The melting points of indium and zinc are used for temperature correction of the device detection unit, and the melting heat of indium is used for correction of heat quantity.

Specifically, measurements are performed under the following conditions by accurately weighing 3 mg of a resin, placing the sample in an aluminum pan, and using an empty aluminum pan as a reference.

Temperature rise rate: 10° C./min
Measurement start temperature: 30° C.
Measurement end temperature: 180° C.

The measurement is performed in a measurement range of 30° C. to 100° C. at a temperature rise rate of 10° C./min. The temperature is raised to 180° C. and held for 10 min, and then the temperature is lowered to 30° C., and thereafter the temperature is raised again. In the second temperature raising process, a change in specific heat is obtained in the temperature range of 30° C. to 100° C. The intersection point of the line at the midpoint between the baselines before and after the specific heat change at this time and the differential thermal curve is taken as a glass transition temperature (Tg).

Method for Measuring Average Circularity of Toner Particle

The average circularity of the toner particle is measured with a flow-type particle image analyzer "FPIA-3000" (manufactured by Sysmex Corp.) under the same measurement and analysis conditions as at the time of calibration operation.

The principle of measurement with the flow-type particle image meter "FPIA-3000" (manufactured by Sysmex Corp.) is in capturing an image of a flowing particle as a static image and performing image analysis. The sample added to a sample chamber is taken by a sample suction syringe and fed to a flat sheath flow cell. The sample fed to the flat sheath flow forms a flat flow sandwiched by sheath fluid. The sample passing through the flat sheath flow cell is irradiated by stroboscopic light at intervals of 1/60 sec, and the image of the flowing particle can be captured as a static image. Further, since the flow is flat, focused images are captured. The image of a particle is captured by a CCD camera and the captured image is processed at an image processing resolution of 512×512 pixels (0.37 μm×0.37 μm per pixel) and a projected area S and a perimeter L of a particle image are measured by extracting the contour of each particle image.

Next, the circle-equivalent diameter and circularity are obtained by using the area S and perimeter L. The circle-equivalent diameter refers to the diameter of a circle having the same area as the projected area of a particle image. The circularity is defined as a value obtained by dividing the perimeter of the circle obtained based on the circle-equivalent diameter by the perimeter of the particle projection image and calculated by the following equation.

$$\text{Circularity}=2\times(\pi\times S)^{1/2}/L.$$

When a particle image is circular, the circularity is 1.000. As the degree of unevenness of the periphery of a particle image increases, the circularity decreases. After the circularity of each particle has been calculated, and an arithmetic mean value of the obtained circularities is calculated and taken as the average circularity.

The specific measurement method is as follows.

Initially, about 20 mL of ion exchanged water from which solid impurities and the like have been removed in advance is placed in a glass container. Then, about 0.2 mL of a diluted solution prepared by diluting "CONTAMINON N" (a 10 mass % aqueous solution of a neutral detergent which has pH of 7 and used for washing precision measurement devices, the neutral detergent including a nonionic surfactant, an anionic surfactant, and an organic builder; manufactured by Wako Pure Chemical Industries, Ltd.) about 3 mass times with ion exchanged water is added as a dispersing agent thereto.

About 0.02 g of the measurement sample is then added, and dispersion treatment is performed for 2 min with an ultrasonic disperser to obtain a dispersion liquid for measurements. At that time, the dispersion liquid is suitably cooled such that the temperature thereof is from 10° C. to 40° C. A prescribed amount of ion exchanged water is placed in a water tank followed by the addition of about 2 mL of the CONTAMINON N to the water tank by using a desktop ultrasonic cleaner/disperser having an oscillation frequency of 50 kHz and an electrical output of 150 W ("VS-150" (manufactured by Velvo-Clear Co., Ltd.)) as the ultrasonic disperser.

During the measurements, the aforementioned flow particle image analyzer equipped with a standard objective lens (magnification factor: 10 times) is used, and the Particle Sheath "PSE-900A" (manufactured by Sysmex Corp.) is used for the sheath liquid. The dispersion liquid prepared in accordance with the aforementioned procedure is introduced into the flow particle image analyzer and 3000 toner particles are counted in the HPF measurement mode using the total count mode.

The average circularity of the toner particle is determined by setting the binarized threshold during particle analysis to 85% and limiting the analyzed particle diameter to a circle-equivalent diameter of from 1.98 μm to 39.69 μm.

In the course of the measurements, focus is adjusted automatically using standard latex particles prior to the start of the measurements ("RESEARCH AND TEST PARTICLES, Latex Microsphere Suspensions 5200A" manufactured by Duke Scientific Corp.). Subsequently, focus is preferably adjusted every 2 h after the start of the measurements.

Separation of the Polyolefin Resin from the Toner, and Measurement of the Content Ratio of Monomer Units Having —COOM and of the Vinyl Polymer in the Polyolefin Resin The polyolefin resin of the toner is separated in accordance with the method below, to allow identifying the content ratio of monomer units having —COOM and of the vinyl polymer in the polyolefin resin.

Specifically, the release agent is extracted from the toner by Soxhlet extraction using a hexane solvent, so that just the polyolefin resin alone can be separated thereafter, on the basis of the solubility difference of the polyester resin and the polyolefin resin towards the solvent.

Concrete examples in which the polyolefin resin alone is extracted include a method in which the polyolefin resin alone is isolated, as a residue, by Soxhlet extraction with an ethyl acetate/1-propanol mixed solvent (mass ratio 8:2). The content can then be identified by thoroughly drying the residue and measuring the mass of the dry residue.

This may be further accompanied with an NMR measurement in order to ascertain the molecular structure of the polyolefin resin that is the extraction residue. The metal ion species contained in the polyolefin resin, and the content of such metal ion species, can be determined by measuring the extraction residue by plasma atomic emission spectroscopy (ICP-AES).

Examples of the production of toners in examples and comparative examples will be explained next.

Production Example of Amorphous Polyester Resin L

Polyoxypropylene(2.2)-2,2-bis (4-hydroxyphenyl)propane: 72.0 parts (0.20 moles; 100.0 mol % with respect to total number of moles of polyhydric alcohol)

Terephthalic acid: 28.0 parts (0.17 moles; 96.0 mol % with respect to total number of moles of polyvalent carboxylic acid)

Tin 2-ethylhexanoate (esterification catalyst): 0.5 parts

The above materials were weighed in a reaction vessel equipped with a cooling tube, a stirrer, a nitrogen introducing tube and a thermocouple. Next, the interior of the flask was purged with nitrogen gas, and thereafter the temperature was gradually raised while under stirring; the reaction was conducted for 4 hours while under stirring at a temperature of 200° C.

Thereafter, the pressure in the reaction vessel was lowered to 8.3 kPa, and this state was maintained for 1 hour, followed by cooling down to 180° C., and returning to atmospheric pressure.

Trimellitic anhydride: 1.3 parts (0.01 moles; 4.0 mol % with respect to total number of moles of polyvalent carboxylic acid)

Tert-butyl catechol (polymerization inhibitor): 0.1 parts

Thereafter the above materials were added, the pressure in the reaction vessel was lowered to 8.3 kPa, and the reaction was conducted for 1 hour while maintaining the temperature at 180° C.; once the softening point was checked to have reached 90° C., the temperature was lowered to stop the reaction, and obtain Amorphous polyester resin L. The weight-average molecular weight was 4500.

Production Example of Amorphous Polyester Resin H

Polyoxypropylene(2.2)-2,2-bis (4-hydroxyphenyl)propane: 72.3 parts (0.20 moles; 100.0 mol % with respect to total number of moles of polyhydric alcohol)

Terephthalic acid: 18.3 parts (0.11 moles; 65.0 mol % with respect to total number of moles of polyvalent carboxylic acid)

Fumaric acid: 2.9 parts (0.03 moles; 15.0 mol % with respect to total number of moles of polyvalent carboxylic acid)

Tin 2-ethylhexanoate (esterification catalyst): 0.5 parts

The above materials were weighed in a reaction vessel equipped with a cooling tube, a stirrer, a nitrogen introducing tube and a thermocouple. Next, the interior of the flask was purged with nitrogen gas, and thereafter the temperature was gradually raised while under stirring; the reaction was conducted for 2 hours while under stirring at a temperature of 200° C.

Thereafter, the pressure in the reaction vessel was lowered to 8.3 kPa, and this state was maintained for 1 hour, followed by cooling down to 180° C., and returning to atmospheric pressure.

Trimellitic anhydride: 6.5 parts (0.03 moles; 20.0 mol % with respect to total number of moles of polyvalent carboxylic acid)

Tert-butyl catechol (polymerization inhibitor): 0.1 parts

Thereafter the above materials were added, the pressure in the reaction vessel was lowered to 8.3 kPa, and the reaction was conducted for 15 hours while maintaining the temperature at 160° C.; once the softening point was checked to have reached 137° C., the temperature was lowered to stop the reaction, and obtain Amorphous polyester resin H. The weight-average molecular weight was 150000.

Production Example of Polyolefin Resin 1

Herein 300 parts of xylene and 10.0 parts of polypropylene (melting point 81° C.) were thoroughly dissolved in an autoclave reaction vessel equipped with a thermometer and a stirrer; then, after purging with nitrogen, a mixed solution of 71.0 parts of styrene, 2.0 parts of acrylic acid, 5.0 parts of cyclohexyl methacrylate, 12.0 parts of butyl acrylate and 250 parts of xylene was added dropwise at 180° C. over 3 hours, to elicit polymerization. Once the polymerization reaction was over, the obtained mixed solution was cooled.

Then a mixed solution of 4.0 parts of a 10 mol/L aqueous solution of lithium hydroxide and 16.0 parts of tetrahydrofuran was added dropwise, and the whole was kept at that temperature for 30 minutes, to elicit neutralization. This was followed by solvent removal, to yield a Polyolefin resin 1 (Table 1) being a graft-polymer in which a vinyl polymer was bound to a polyolefin.

Production Examples of Polyolefin Resins 2 to 8

An operation identical to that of the production example of Polyolefin resin 1 was carried out, but herein the amount of acrylic acid and the type and amount of the hydroxide for neutralization were modified, as given in Table 1, with respect to those in the production example of Polyolefin resin 1, to yield Polyolefin resins 2 to 8 being graft-polymers in which a vinyl polymer was bound to a polyolefin.

The same operation as in the production example of Polyolefin resin 1 was carried out to produce Polyolefin resin 8, but in this case without addition of metal ions.

TABLE 1

| Polyolefin resin No. | Polyolefin Polypropylene Parts | Vinyl polymer Styrene Parts | —COOM-containing monomer COO— monomer | Metal ion | Parts | Cyclohexyl methacrylate Parts | Butyl acrylate Parts |
|---|---|---|---|---|---|---|---|
| 1 | 10 | 71 | Acrylic acid | Li | 2 | 5 | 12 |
| 2 | 10 | 68 | Acrylic acid | Li | 5 | 5 | 12 |
| 3 | 10 | 61 | Acrylic acid | Li | 12 | 5 | 12 |
| 4 | 10 | 55 | Acrylic acid | Li | 18 | 5 | 12 |
| 5 | 10 | 48 | Acrylic acid | Li | 25 | 5 | 12 |
| 6 | 10 | 63 | Acrylic acid | Na | 10 | 5 | 12 |

TABLE 1-continued

| Polyolefin resin No. | Polyolefin Polypropylene Parts | Vinyl polymer Styrene Parts | —COOM-containing monomer COO— monomer | Metal ion | Parts | Cyclohexyl methacrylate Parts | Butyl acrylate Parts |
|---|---|---|---|---|---|---|---|
| 7 | 10 | 63 | Acrylic acid | K | 10 | 5 | 12 |
| 8 | 10 | 68 | Acrylic acid | — | 5 | 5 | 12 |

Production Example of Toner 1

| | |
|---|---|
| Amorphous polyester resin L: | 65 parts |
| Amorphous polyester resin H: | 35 parts |
| Polyolefin resin 1: | 8 parts |
| Fischer-Tropsch wax (hydrocarbon wax; peak temperature of maximum endothermic peak = 90° C.): | 8 parts |
| C.I. Pigment blue 15:3: | 7 parts |
| Aluminum 3,5-di-t-butylsalicylate compound (Bontron E88, by Orient Chemical Industries Co., Ltd.): | 0.3 parts |

The above materials were mixed using a Henschel mixer (FM-75 Model, by Mitsui Mining Co., Ltd.) at a rotation speed of 20 $s^{-1}$ and over a rotation time of 5 min, followed by kneading using a twin-screw kneader (PCM-30 Model, by Ikegai Corp). The barrel temperature at the time of kneading was set so that the outlet temperature of the kneaded product was 120° C. The outlet temperature of the kneaded product was directly measured using a handy-type thermometer (HA-200E, by Anritsu Meter Co., Ltd.).

The obtained kneaded product was cooled, and was coarsely pulverized to 1 mm or less, using a hammer mill, to yield a crushed product. The obtained crushed product was finely pulverized using a mechanical pulverizer (T-250, by Turbo Kogyo Co., Ltd.). The resulting product was classified using FACULTY F-300 (by Hosokawa Micron Corporation), to yield Toner particle 1. The operation conditions were set to a classification rotor speed of 130 $s^{-1}$, and a dispersion rotor speed of 120 $s^{-1}$.

A thermal treatment was performed using the obtained Toner particle 1, in the surface treatment device illustrated in the FIGURE, to thereby obtain a thermally treated particle of Toner particle 1. The operation conditions involved setting a feed amount=5 kg/hr, hot air current temperature=150° C., hot air current flow rate=6 $m^3$/min, cold air temperature=−5° C., cold air flow rate=4 $m^3$/min, blower air volume=20 $m^3$/min and injection air flow rate=1 $m^3$/min.

Then 1.0 part of hydrophobic silica (BET: 200 $m^2$/g) and 1.0 part of titanium oxide fine particles (BET: 80 $m^2$/g) surface-treated with isobutyl trimethoxysilane, relative to 100 parts of the obtained thermally treated particle of Toner particle 1, were mixed in a Henschel mixer (FM-75 Model, by Mitsui Mining Co., Ltd.) at a rotational speed of 30 $s^{-1}$ and over a rotation time of 10 min, to yield Toner 1.

Production Example of Toner 2

Toner 2 was obtained by performing the same operation as in the production example of Toner 1, but modifying herein Polyolefin resin 1 in production example of Toner 1 to Polyolefin resin 4.

Production Example of Toner 3

| | |
|---|---|
| Amorphous polyester resin L: | 65 parts |
| Amorphous polyester resin H: | 35 parts |
| Polyolefin resin 2: | 8 parts |
| Fischer-Tropsch wax (hydrocarbon wax; peak temperature of maximum endothermic peak = 90° C.): | 8 parts |
| C.I. Pigment blue 15:3: | 7 parts |
| Aluminum 3,5-di-t-butylsalicylate compound (Bontron E88, by Orient Chemical Industries Co., Ltd.): | 0.3 parts |

The above materials were mixed using a Henschel mixer (FM-75 Model, by Mitsui Mining Co., Ltd.) at a rotation speed of 20 $s^{-1}$ and over a rotation time of 5 min, followed by kneading using a twin-screw kneader (PCM-30 Model, by Ikegai Corporation). The barrel temperature at the time of kneading was set so that the outlet temperature of the kneaded product was 120° C. The outlet temperature of the kneaded product was directly measured using a handy-type thermometer (HA-200E, by Anritsu Meter Co., Ltd.).

The obtained kneaded product was cooled, and was coarsely pulverized to 1 mm or less, using a hammer mill, to yield a crushed product. Then Kneaded crushed product 1 was finely pulverized using a mechanical pulverizer (T-250, by Turbo Kogyo Co. Ltd.), at operation conditions that involved a rotor speed of 12000 rpm. Then classification was carried out under operation conditions of classification rotor speed of 9000 rpm and dispersion rotor speed of 7200 rpm, using FACULTY (F-300, by Hosokawa Micron Corporation), to yield Small-sized toner particle F2 containing Polyolefin resin 2.

Next, the materials below were mixed using a Henschel mixer (FM-75 Model, by Mitsui Mining Co., Ltd.) at a rotation speed of 20 $s^{-1}$ and over a rotation time of 5 min, followed by kneading using a twin-screw kneader (PCM-30 Model, by Ikegai Corporation). The barrel temperature at the time of kneading was set so that the outlet temperature of the kneaded product was 120° C.

| | |
|---|---|
| Amorphous polyester resin L: | 65 parts |
| Amorphous polyester resin H: | 35 parts |
| Polyolefin resin 1: | 8 parts |
| Fischer-Tropsch wax (hydrocarbon wax; peak temperature of maximum endothermic peak = 90° C.): | 8 parts |
| C.I. Pigment blue 15:3: | 7 parts |
| Aluminum 3,5-di-t-butylsalicylate compound (Bontron E88, by Orient Chemical Industries Co., Ltd.): | 0.3 parts |

The barrel temperature at the time of kneading was set so that the outlet temperature of the kneaded product was 120° C. The outlet temperature of the kneaded product was directly measured using a handy-type thermometer (HA-200E, by Anritsu Meter Co., Ltd.).

The obtained kneaded product was cooled, and was coarsely pulverized to 1 mm or less, using a hammer mill, to yield a crushed product. Then pulverization classification was carried out with the operation conditions of the mechanical pulverizer set to a rotor speed of 10000 rpm and the operation conditions of FACULTY set to classification rotor speed of 8000 rpm and dispersion rotor speed of 7200 rpm, to yield Large-sized toner particle M1 containing Polyolefin resin 1.

The obtained Small-sized toner particle F2 containing Polyolefin resin 2 and Large-sized toner particle M1 containing Polyolefin resin 1 were mixed at a mass ratio of 1:1. A thermal treatment was then performed using the surface treatment device illustrated in the FIGURE, to thereby obtain a thermally treated particle of Toner particle 3.

The operation conditions involved setting a feed amount=5 kg/hr, hot air current temperature=150° C., hot air current flow rate=6 $m^3$/min, cold air temperature=−5° C., cold air flow rate=4 $m^3$/min, blower air volume=20 $m^3$/min and injection air flow rate=1 $m^3$/min.

Then 1.0 part of hydrophobic silica (BET: 200 $m^2$/g) and 1.0 part of titanium oxide fine particles (BET: 80 $m^2$/g) surface-treated with isobutyl trimethoxysilane, relative to 100 parts of the obtained thermally treated particle of the toner particle mixture, were mixed in a Henschel mixer (FM-75 Model, by Mitsui Mining Co., Ltd.) at a rotational speed of 30 $s^{-1}$ and over a rotation time of 10 min, to yield Toner 3.

Production Example of Toner 4

Herein Toner 4 was obtained by performing the same operations of production example of Toner 3 but modifying Polyolefin resin 2 in the production example of Toner 3 to Polyolefin resin 3, and by mixing Small-sized toner particle F3 containing Polyolefin resin 3 and Large-sized toner particle M1 containing Polyolefin resin 1.

Production Example of Toner 5

Herein Toner 5 was obtained by performing the same operations of production example of Toner 3 but modifying Polyolefin resin 2 in the production example of Toner 3 to Polyolefin resin 4, and by mixing Small-sized toner particle F4 containing Polyolefin resin 4 and Large-sized toner particle M1 containing Polyolefin resin 1.

Production Example of Toner 6

| | |
|---|---|
| Amorphous polyester resin L: | 65 parts |
| Amorphous polyester resin H: | 35 parts |
| Polyolefin resin 4: | 8 parts |
| Fischer-Tropsch wax (hydrocarbon wax; peak temperature of maximum endothermic peak = 90° C.): | 16 parts |
| C.I. Pigment blue 15:3: | 7 parts |
| Aluminum 3,5-di-t-butylsalicylate compound (BONTRON E88, by Orient Chemical Industries Co., Ltd.): | 0.3 parts |

The above materials were mixed using a Henschel mixer (FM-75 Model, by Mitsui Mining Co., Ltd.) at a rotation speed of 20 $s^{-1}$ and over a rotation time of 5 min, followed by kneading using a twin-screw kneader (PCM-30 Model, by Ikegai Corp). The barrel temperature at the time of kneading was set so that the outlet temperature of the kneaded product was 120° C. The outlet temperature of the kneaded product was directly measured using a handy-type thermometer (HA-200E, by Anritsu Meter Co., Ltd.).

The obtained kneaded product was cooled, and was coarsely pulverized to 1 mm or less, using a hammer mill, to yield a crushed product. Then Kneaded crushed product 1 was finely pulverized using a mechanical pulverizer (T-250, by Turbo Kogyo Co. Ltd.), at operation conditions that involved a rotor speed of 12000 rpm. Then classification was carried out using FACULTY (F-300, by Hosokawa Micron Corporation) under operation conditions of classification rotor speed of 9000 rpm and dispersion rotor speed of 7200 rpm, to yield Small-sized toner particle F4-2 containing Polyolefin resin 4.

Next, the materials below were mixed using a Henschel mixer (FM-75 Model, by Mitsui Mining Co., Ltd.) at a rotation speed of 20 $s^{-1}$ and over a rotation time of 5 min, followed by kneading using a twin-screw kneader (PCM-30 Model, by Ikegai Corporation). The barrel temperature at the time of kneading was set so that the outlet temperature of the kneaded product was 120° C.

| | |
|---|---|
| Amorphous polyester resin L: | 65 parts |
| Amorphous polyester resin H: | 35 parts |
| Polyolefin resin 1: | 8 parts |
| Fischer-Tropsch wax (hydrocarbon wax; peak temperature of maximum endothermic peak = 90° C.): | 8 parts |
| C.I. Pigment blue 15:3: | 7 parts |
| Aluminum 3,5-di-t-butylsalicylate compound (Bontron E88, by Orient Chemical Industries Co., Ltd.): | 0.3 parts |

The barrel temperature at the time of kneading was set so that the outlet temperature of the kneaded product was 120° C. The outlet temperature of the kneaded product was directly measured using a handy-type thermometer (HA-200E, by Anritsu Meter Co., Ltd.).

The obtained kneaded product was cooled, and was coarsely pulverized to 1 mm or less, using a hammer mill, to yield a crushed product. Then pulverization classification was carried out with the operation conditions of the mechanical pulverizer set to a rotor speed of 10000 rpm and the operation conditions of FACULTY set to classification rotor speed of 8000 rpm and dispersion rotor speed of 7200 rpm, to yield Large-sized toner particle M1-2 containing Polyolefin resin 1.

Then Small-sized toner particle F4-2 containing Polyolefin resin 4 and Large-sized toner particle M1-2 containing Polyolefin resin 1 obtained above were mixed at a mass ratio of 1:1. A thermal treatment was then performed using the surface treatment device illustrated in the FIGURE, to thereby obtain a thermally treated particle of Toner particle 6.

The operation conditions involved setting a feed amount=5 kg/hr, hot air current temperature=150° C., hot air current flow rate=6 $m^3$/min, cold air temperature=−5° C., cold air flow rate=4 $m^3$/min, blower air volume=20 $m^3$/min and injection air flow rate=1 $m^3$/min.

Then 1.0 part of hydrophobic silica (BET: 200 $m^2$/g) and 1.0 part of titanium oxide fine particles (BET: 80 $m^2$/g) surface-treated with isobutyl trimethoxysilane, relative to 100 parts of the obtained thermally treated particle of the toner particle mixture were mixed in a Henschel mixer (FM-75 Model, by Mitsui Mining Co., Ltd.) at a rotational speed of 30 $s^{-1}$ and over a rotation time of 10 min, to yield Toner 6.

Production Example of Toner 7

Herein Toner 7 was obtained by performing the same operations of production example of Toner 3 but modifying Polyolefin resin 2 in the production example of Toner 3 to Polyolefin resin 6, and by mixing Small-sized toner particle F6 containing Polyolefin resin 6 and Large-sized toner particle M1 containing Polyolefin resin 1.

Production Example of Toner 8

Herein Toner 8 was obtained by performing the same operations of production example of Toner 3, but modifying Polyolefin resin 2 in the production example of Toner 3 to Polyolefin resin 7, and by mixing Small-sized toner particle F7 containing Polyolefin resin 7 and Large-sized toner particle M1 containing Polyolefin resin 1.

Production Example of Toner 9

Herein Toner 9 was obtained by performing the same operations of production example of Toner 3 with the exceptions of modifying Polyolefin resin 2 in the production example of Toner 3 to Polyolefin resin 1, modifying Polyolefin resin 1 in the production example of Toner 3 to Polyolefin resin 4, and mixing Small-sized toner particle F1 containing Polyolefin resin 1 and Large-sized toner particle M4 containing Polyolefin resin 4.

Production Example of Toner 10

Herein Toner 10 was obtained by performing the same operations of production example of Toner 3 with the exceptions of modifying Polyolefin resin 1 in the production example of Toner 3 to Polyolefin resin 3, and mixing Small-sized toner particle F2 containing Polyolefin resin 2 and Large-sized toner particle M3 containing Polyolefin resin 3.

Production Example of Toner 11

Toner 11 was obtained by performing the same operation as in the production example of Toner 1, but modifying herein Polyolefin resin 1 in production example of Toner 1 to Polyolefin resin 5.

Production Example of Toner 12

Toner 12 was obtained by performing the same operation as in the production example of Toner 1, but modifying herein Polyolefin resin 1 in production example of Toner 1 to Polyolefin resin 8.

The obtained Toners 1 to 1 were divided into two substantially equal parts, on a number basis, into a large particle size side and a small particle size side (to a difference in the numbers of particles of 4% or less) using an Elbow-jet (by Nittetsu Mining Co., Ltd.) of an inertial classification system, to obtain a first group and a second group, and each toner was then evaluated.

The operation conditions of the Elbow-jet were adjusted to feed amount=5 kg/hr, a fine powder classification edge from 10 mm to 15 mm, and the coarse powder classification edge was closed at maximum, so that each toner was divided into two substantially equal parts, corresponding to a first group and a second group. The results are given in Table 2.

TABLE 2

| Toner | Particle size distribution | | Polyolefin resin | | ATR-IR spectrum | | | | | | | Charge distribution | | |
|---|---|---|---|---|---|---|---|---|---|---|---|---|---|---|
| | | | | COOM content | | | | | | | (As/Bs) | | | |
| No. | D50 | Span | No. | (mass %) | As | Bs | As/Bs | Al | Bl | Al/Bl | (Al/Bl) | σs | σl | σs/σl |
| 1 | 6.0 | 0.80 | 1 | 2 | 0.042 | 0.038 | 1.11 | 0.03 | 0.03 | 1.00 | 1.11 | 0.045 | 0.043 | 1.05 |
| 2 | 6.0 | 0.80 | 4 | 18 | 0.080 | 0.044 | 1.82 | 0.06 | 0.04 | 1.50 | 1.21 | 0.055 | 0.049 | 1.11 |
| 3 | 5.6 | 0.65 | 1 + 2 | 3.5 | 0.048 | 0.040 | 1.20 | 0.03 | 0.03 | 1.00 | 1.20 | 0.046 | 0.043 | 1.07 |
| 4 | 5.5 | 0.60 | 1 + 3 | 7 | 0.064 | 0.042 | 1.52 | 0.03 | 0.03 | 1.00 | 1.52 | 0.049 | 0.043 | 1.14 |
| 5 | 5.6 | 0.65 | 1 + 4 | 10 | 0.080 | 0.044 | 1.82 | 0.03 | 0.03 | 1.00 | 1.82 | 0.055 | 0.043 | 1.28 |
| 6 | 5.5 | 0.60 | 1 + 4 | 10 | 0.090 | 0.046 | 1.96 | 0.03 | 0.03 | 1.00 | 1.96 | 0.061 | 0.043 | 1.42 |
| 7 | 5.5 | 0.60 | 1 + 6 | 6 | 0.064 | 0.042 | 1.52 | 0.03 | 0.03 | 1.00 | 1.52 | 0.046 | 0.043 | 1.07 |
| 8 | 5.6 | 0.65 | 1 + 7 | 6 | 0.064 | 0.042 | 1.52 | 0.03 | 0.03 | 1.00 | 1.52 | 0.043 | 0.043 | 1.00 |
| 9 | 5.5 | 0.60 | 4 + 1 | 10 | 0.042 | 0.038 | 1.11 | 0.06 | 0.04 | 1.50 | 0.74 | 0.044 | 0.049 | 0.89 |
| 10 | 5.5 | 0.60 | 2 + 3 | 8.5 | 0.064 | 0.042 | 1.52 | 0.06 | 0.04 | 1.50 | 1.02 | 0.046 | 0.048 | 0.96 |
| 11 | 6.0 | 0.80 | 5 | 25 | 0.110 | 0.051 | 2.16 | 0.05 | 0.05 | 1.00 | 2.16 | 0.087 | 0.042 | 2.07 |
| 12 | 6.0 | 0.80 | 8 | 0 | 0 | 0 | 0 | 0 | 0 | 0 | 0.00 | 0.035 | 0.035 | 1.00 |

In the table, D50 denotes the number-basis median diameter (μm) of each toner, span denotes a span value obtained on the basis of Expression (2), and COOM content denotes the content ratio of the monomer units containing —COOM in the polyolefin resin having —COOM.

Production Example of Magnetic Core Particle 1

Step 1 (Weighing and Mixing Step):

| | |
|---|---|
| $Fe_2O_3$ | 62.7 parts |
| $MnCO_3$ | 29.5 parts |
| $Mg(OH)_2$ | 6.8 parts |
| $SrCO_3$ | 1.0 part |

The above materials were weighed so as to obtain the above composition ratio. Thereafter, the materials were pulverized and mixed for 5 h with a dry vibration mill using stainless steel beads having a diameter of ⅛ inch.

Step 2 (Pre-Baking Step):

The pulverized product obtained was made into about 1 mm square pellets with a roller compactor. This pellets were subjected to removal of coarse powder with a vibrating sieve having a mesh size of 3 mm, and then fine powder was removed with a vibrating sieve having a mesh size of 0.5 mm. A pre-baked ferrite was prepared by baking at a temperature of 1000° C. for 4 h under a nitrogen atmosphere (oxygen concentration: 0.01% by volume) by using a burner-type baking furnace. The obtained pre-baked ferrite had the following composition.

$$(MnO)_a(MgO)_b(SrO)_c(Fe_2O_3)_d$$

In the above formula, a=0.257, b=0.117, c=0.007, and d=0.393.

Step 3 (Pulverization Step):

After pulverizing the pre-baked ferrite to about 0.3 mm with a crusher, 30 parts of water was added to 100 parts of the pre-baked ferrite and pulverization was carried out for 1 h by using a wet ball mill with zirconia beads having a diameter of ⅛ inch. The obtained slurry was pulverized with a wet ball mill using alumina beads having a diameter of 1/16 inch for 4 h to obtain a ferrite slurry (finely pulverized product of pre-baked ferrite).

Step 4 (Granulation Step):

A total of 1.0 part of ammonium polycarboxylate as a dispersing agent and 2.0 parts of polyvinyl alcohol as a binder were added, with respect to 100 parts of the pre-baked ferrite, to the ferrite slurry, followed by granulation into spherical particles with a spray drier (manufacturer: Ohkawara Kakohki Co., Ltd.). The obtained particles were adjusted in particle size and then heated at 650° C. for 2 h using a rotary kiln to remove organic components of the dispersing agent and the binder.

Step 5 (Baking Step):

In order to control the baking atmosphere, the temperature was raised in an electric furnace from room temperature to 1300° C. under a nitrogen atmosphere (oxygen concentration 1.00% by volume) in 2 h and then baking of spherical particles obtained in the Step 4 was carried out at a temperature of 1150° C. for 4 h. The temperature was then lowered to 60° C. over 4 h, the air atmosphere was restored from the nitrogen atmosphere, and the particles were taken out at a temperature of 40° C. or lower.

Step 6 (Screening Step):

After disaggregating the aggregated spherical particles, a low-magnetic-force product was cut by magnetic separation, and the coarse particles were removed by sieving with a sieve having a mesh size of 250 μm to obtain magnetic core particles 1 having a 50% particle diameter based on volume distribution of 37.0 μm.

Preparation of Coating Resin 1

Cyclohexyl methacrylate monomer 26.8% by mass
Methyl methacrylate monomer 0.2% by mass
Methyl methacrylate macromonomer 8.4% by mass (macromonomer having methacryloyl group at one end and a weight average molecular weight of 5000)
Toluene 31.3% by mass
Methyl ethyl ketone 31.3% by mass The above materials were placed in a four-necked separable flask equipped with a reflux condenser, a thermometer, a nitrogen introducing tube, and a stirrer. Nitrogen gas was introduced into the flask to obtain a sufficiently nitrogen atmosphere, followed by heating to 80° C. Thereafter, 2.0% by mass of azobisisobutyronitrile was added and refluxing and polymerization were conducted for 5 h. Hexane was injected into the resulting reaction product to precipitate and deposit the copolymer, and the precipitate was filtered off and vacuum dried to obtain a coating resin 1.

A total of 30 parts of the coating resin 1 thus obtained was dissolved in 40 parts of toluene and 30 parts of methyl ethyl ketone to obtain a polymer solution 1 (solid fraction: 30% by mass).

Preparation of Coating Resin Solution 1

Polymer solution 1 (resin solid fraction concentration: 30% by mass) 33.3% by mass
Toluene 66.4% by mass
Carbon black (Regal 330; manufactured by Cabot Corporation) 0.3% by mass (primary particle diameter 25 nm, nitrogen adsorption specific surface area 94 $m^2/g$, DBP oil absorption amount 75 ml/100 g)

The abovementioned materials were dispersed for 1 h with a paint shaker using zirconia beads having a diameter of 0.5 mm. The resulting dispersion was filtered with a membrane filter of 5.0 μm to obtain a coating resin solution 1.

Production Example of Magnetic Carrier 1

Resin Coating Step:

The magnetic core particles 1 and the coating resin solution 1 were loaded into a vacuum degassing type kneader maintained at normal temperature (the loaded amount of the coating resin solution 1 was 2.5 parts as a resin component with respect to 100 parts of the magnetic core particles 1). After loading, the components were stirred at a revolution speed of 30 rpm for 15 min. After the solvent was volatilized to a certain extent (80% by mass) or more, the temperature was raised to 80° C. while mixing under reduced pressure, and toluene was distilled off over 2 h, followed by cooling. The obtained magnetic carrier was subjected to fractionation of a low-magnetic-force product by magnetic separation, sieving with a sieve having a mesh size of 70 μm, and classification with an air classifier to obtain a magnetic carrier 1 having a 50% particle diameter (D50) based on volume distribution of 38.2 μm.

Production Example of a Two-Component Developer

Herein Two-component developer 1 was obtained through mixing of 8.0 parts of Toner 1 and 92.0 parts of Magnetic carrier 1 in a V-type mixer (V-20, by Seishin Enterprise Co., Ltd.). Similarly, Toners 2 to 12 were mixed with Magnetic carrier 1, to yield Two-component developers 2 to 12.

Example 1

Developer Evaluation

The evaluations below were carried out using the above Two-component developer 1.

A modified machine of a digital commercial printer imageRUNNER ADVANCE C5560, by Canon Inc., was used as the image forming apparatus. The apparatus was modified so that fixation temperature, process speed, DC voltage $V_{DC}$ of the developer carrier, charging voltage $V_D$ of an electrostatic latent image bearing member and laser power could be set freely.

To evaluate image output, an FFh image (solid image) having a desired image ratio was outputted, with $V_{DC}$, $V_D$ and laser power being adjusted in such a manner that the amount of toner on the FFh image was as desired, and then the evaluation below was carried out. The value FFh denotes herein a value obtained by displaying 256 gradations in hexadecimal notation, with 00 h as the first of the 256 gradations (white background portion) and FFh as the 256th gradation (solid portion).

Suppression of Fogging

Two-component developer 1 was placed in a black developing device of the above image forming apparatus, the evaluation image was outputted under the following conditions, and suppression of fogging was evaluated.

Paper: CS-680(68.0 g/m$^2$) (by Canon Marketing Japan Inc.)

Evaluation image: 00 h image on entire surface of the above A4 paper

Vback: 150 V (adjusted on the basis of the DC voltage $V_{DC}$ of the developer carrier, the charging voltage $V_D$ of the electrostatic latent image bearing member, and laser power)

Test environment: high-temperature high-humidity environment (temperature 30° C./humidity 80% RH)

Fixation temperature: 170° C.

Process speed: 377 mm/sec

The fogging value defined below was used as an evaluation index of fogging suppression.

Firstly, an average reflectance Ds (%) of the evaluation paper before being outputted is measured using a reflectometer (REFLECTOMETER MODEL TC-6DS: by Tokyo Denshoku Co., Ltd.). The average reflectance Dr (%) of the outputted evaluation paper is measured. The value calculated on the basis of the expression below is taken as the fogging value. The obtained fogging value was evaluated in accordance with the criteria below. The effect of the present invention was deemed to be achieved for results of D and better.

Fogging value=Dr (%)−Ds (%)

Evaluation Criteria

A: Fogging value lower than 0.3%

B: Fogging value from 0.3% to less than 0.5%

C: Fogging value from 0.5% to less than 0.8%

D: Fogging value from 0.8% to less than 1.2%

E: Fogging value of 1.2% or higher

Image Density Stability

Two-component developer 1 was placed in a cyan developing device of the above image forming apparatus, an evaluation image was outputted under the conditions below, and image density stability was evaluated.

Paper: GFC-081 (81.0 g/m$^2$) (by Canon Marketing Japan Inc.)

Vcontrast (adjusted on the basis of the DC voltage $V_{DC}$ of the developer carrier, the charging voltage $V_D$ of the electrostatic latent image bearing member and laser power): 350 V Evaluation image: 2 cm×5 cm image disposed on center of the above A4 paper Test environment: normal-temperature, high-humidity environment: temperature 23° C./humidity 5% RH Fixation temperature: 170° C.

Process speed: 377 mm/sec

The value of image density was taken as an evaluation index. Image density at a central portion was measured using an X-Rite color reflection densitometer (500 Series, by X-Rite, Inc.). The obtained value of image density was evaluated in accordance with the criteria below. The effect of the present invention was deemed to be achieved for results of C and better.

Evaluation Criteria

A: Value of image density of 1.35 or higher

B: Value of image density from 1.30 to less than 1.35

C: Value of image density from 1.25 to less than 1.30

D: Value of image density of lower than 1.25

Examples 2 to 8 and Comparative Examples 1 to 4

The same evaluations as in Example 1 were carried out but using herein Two-component developers 2 to 12. The evaluation results are given in Table 3.

TABLE 3

| | Two-component developer No. | Evaluation | |
|---|---|---|---|
| | | Fogging | Image stability |
| Example 1 | 1 | D | A |
| Example 2 | 2 | C | B |
| Example 3 | 3 | C | A |
| Example 4 | 4 | B | A |
| Example 5 | 5 | A | B |
| Example 6 | 6 | A | B |
| Example 7 | 7 | C | A |
| Example 8 | 8 | C | A |
| Comparative example 1 | 9 | E | B |
| Comparative example 2 | 10 | E | B |
| Comparative example 3 | 11 | B | D |
| Comparative example 4 | 12 | E | A |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-156273, filed Aug. 29, 2019, which is hereby incorporated by reference herein in its entirety.

What is claimed is:

1. A toner, comprising:

a toner particle that contains a binder resin and a polyolefin resin;

the binder resin including a polyester resin;

the polyolefin resin having a carboxy group neutralized with a monovalent metal ion M forming —COOM, the polyolefin resin having —COOM being a polymer in which a vinyl polymer is bonded to a polyolefin with a content ratio of a monomer unit containing —COOM being 1 to 20 mass %, wherein when the toner is divided by an inertial classifier into a first including a larger size of the toner particles, and a second group including a smaller size of the toner particles, with the number of toner particles in the first group being substantially equal to the number of toner particles in the second group, the toner satisfies $$1.50 \leq (As/Bs)/(Al/Bl) \leq 2.00$$

and $$1.14 \leq \sigma s/\sigma l \leq 1.50$$

where As denotes a ratio of an intensity of a maximum absorption peak in a range from 1545 $cm^{-1}$ to 1555 $cm^{-1}$, assigned to —COOM contained in the polyolefin resin, with respect to an intensity of a maximum absorption peak in a range from 1713 $cm^{-1}$ to 1723 $cm^{-1}$, assigned to carbonyl in the polyester resin, in a FT-IR spectrum obtained through measurement of the second group in accordance with an ATR method, using Ge as an ATR crystal, and under a condition where an infrared light incidence angle is set to 45°, Bs denotes a ratio of an intensity of a maximum absorption peak in a range from 1545 $cm^{-1}$ to 1555 $cm^{-1}$, assigned to —COOM contained in the polyolefin resin, with respect to an intensity of a maximum absorption peak in a range from 1713 $cm^{-1}$ to 1723 $cm^{-1}$, assigned to carbonyl in the polyester resin, in a FT-IR spectrum obtained through measurement of the second group in accordance with an ATR method, using diamond as an ATR crystal, and under a condition where an infrared light incidence angle is set to 45°, Al denotes a ratio of an intensity of a maximum absorption peak in a range from 1545 $cm^{-1}$ to 1555 $cm^{-1}$, assigned to —COOM contained in the polyolefin resin, with respect to an intensity of a maximum absorption peak in a range from 1713 $cm^{-1}$ to 1723 $cm^{-1}$, assigned to carbonyl in the polyester resin, in a FT-IR spectrum obtained through measurement of the first group in accordance with an ATR method, using Ge as an ATR crystal, and under a condition where an infrared light incidence angle is set to 45°, Bl denotes a ratio of an intensity of a maximum absorption peak in a range from 1545 $cm^{-1}$ to 1555 $cm^{-1}$, assigned to —COOM contained in the polyolefin resin, with respect to an intensity of a maximum absorption peak in a range from 1713 $cm^{-1}$ to 1723 $cm^{-1}$, assigned to carbonyl in the polyester resin, in a FT-IR spectrum obtained through measurement of the first group in accordance with an ATR method, using diamond as an ATR crystal, and under a condition where an infrared light incidence angle is set to 45°, σs denotes an absolute value of an average value of surface charge density of the second group, and σl denotes an absolute value of an average value of surface charge density of the first group.

2. The toner according to claim 1, wherein the toner has a number-basis median diameter D50 of 3.0 to 6.0 μm, and $$(D90-D10)/D50 \text{ is } 0.20 \text{to} 0.80$$

where D90 is a particle diameter of the toner at which a cumulative number of particles in increasing order of particle diameter is 90%, and D10 is a particle diameter of the toner at which a cumulative number of particles in increasing order of particle diameter is 10%.

3. The toner according to claim 1, wherein a content ratio of the vinyl polymer in the polyolefin resin having —COOM is 80 to 95 mass %.

4. The toner according to claim 1, wherein M is $Li^+$.

5. The toner according to claim 1, wherein a content ratio of the monomer unit containing —COOM in the polyolefin resin having —COOM is 6 to 20 mass %.

6. The toner according to claim 1, wherein the vinyl polymer has a structure derived from a cycloalkyl (meth) acrylate.

7. The toner according to claim 1, wherein $1.15 \leq \sigma s/\sigma l \leq 1.45$ when σs is an absolute value of an average value of surface charge density of the second group and σl is an absolute value of an average value of surface charge density of the first group.

8. The toner according to claim 1, wherein the monomer unit containing —COOM is represented by

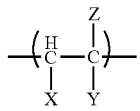

where X is a hydrogen atom or —COOM, Y is $—(CH_2)_m—COOM$, m is an integer from 0 to 3, and Z is a hydrogen atom, a C1 to C3 alkyl group or —COOM.

9. A method of producing the toner according to claim 1, the method comprising the steps of:

melt-kneading a resin composition containing the polyolefin resin having —COOM and the binder resin including the polyester resin to obtain a kneaded product;

cooling the kneaded product to obtain a cooled product;

pulverizing the cooled product to obtain a toner particle; and subjecting the toner particle to a thermal treatment by a hot air current having a temperature of 110° C. or higher.

* * * * *